US008820878B2

(12) United States Patent
Yatsunami

(10) Patent No.: US 8,820,878 B2
(45) Date of Patent: Sep. 2, 2014

(54) LIQUID EJECTING APPARATUS AND SENSOR SENSITIVITY SETTING METHOD IN LIQUID EJECTING APPARATUS

(71) Applicant: Seiko Epson Corporation, Tokyo (JP)

(72) Inventor: Tetsuji Yatsunami, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 25 days.

(21) Appl. No.: 13/773,064

(22) Filed: Feb. 21, 2013

(65) Prior Publication Data

US 2013/0215182 A1 Aug. 22, 2013

(30) Foreign Application Priority Data

Feb. 21, 2012 (JP) ..... 2012-034855

(51) Int. Cl.
*B41J 29/38* (2006.01)

(52) U.S. Cl.
USPC ..... 347/16

(58) Field of Classification Search
USPC ..... 347/16, 101, 104, 105; 400/120.02, 400/223, 249; 271/258.01, 265.01, 275, 271/276
See application file for complete search history.

(56) References Cited

U.S. PATENT DOCUMENTS

| | | | | |
|---|---|---|---|---|
| 5,079,565 | A * | 1/1992 | Shimizu et al. | 400/249 |
| 5,447,382 | A * | 9/1995 | Yui et al. | 400/120.02 |
| 5,531,527 | A * | 7/1996 | Maekawa et al. | 400/120.02 |
| 5,755,519 | A * | 5/1998 | Klinefelter | 400/223 |
| 7,878,505 | B2 * | 2/2011 | Meier et al. | 271/176 |

FOREIGN PATENT DOCUMENTS

| | | | |
|---|---|---|---|
| JP | 11-227176 | A | 8/1999 |
| JP | 2002-127521 | A | 5/2002 |
| JP | 2003-260829 | A | 9/2003 |
| JP | 2010-194748 | A | 9/2010 |
| JP | 2010-221603 | A | 10/2010 |

* cited by examiner

*Primary Examiner* — Kristal Feggins
(74) *Attorney, Agent, or Firm* — Global IP Counselors, LLP

(57) ABSTRACT

This is to provide a liquid ejecting apparatus and a sensor sensitivity setting method in a liquid ejecting apparatus making it possible to keep low any fluctuations in the reflectance of a reflecting part used to measure the sensitivity of an optical sensor provided to a carriage, and to enhance the accuracy of measurement sensitivity, thus making it possible to ensure the required sensitivity even in spite of progressive deterioration of the optical sensor.

9 Claims, 12 Drawing Sheets

CONTROL UNIT 50

ROM
52
RAM
53
NON-VOLATILE MEMORY
54
EDGE DETECTION PROCESSING UNIT
61
SENSITIVITY SETTING PROCESSING UNIT
62
CPU
51
DRIVE CIRCUIT
55
DRIVE CIRCUIT
56
DRIVE CIRCUIT
57
LIQUID EJECTING HEAD
19
CARRIAGE MOTOR
35
CONVEYANCE MOTOR
41
LINEAR ENCODER
39
LIGHT-EMITTING UNIT
58
LIGHT-RECEIVING UNIT
59
SENSITIVITY SETTING CIRCUIT
60
SHEET WIDTH SENSOR 48

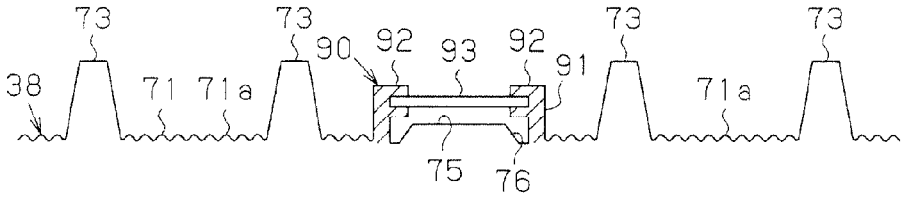
Fig. 16
Fig. 17A
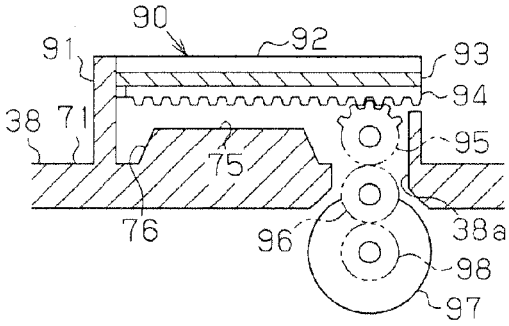
Fig. 17B
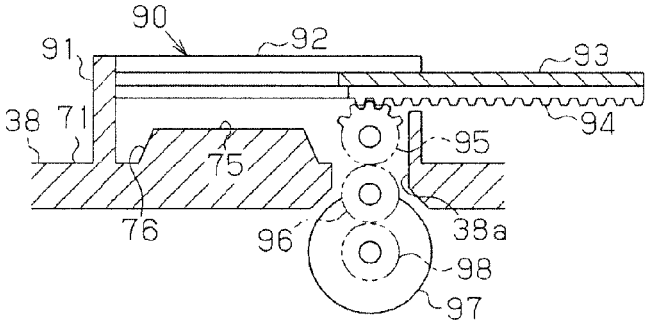
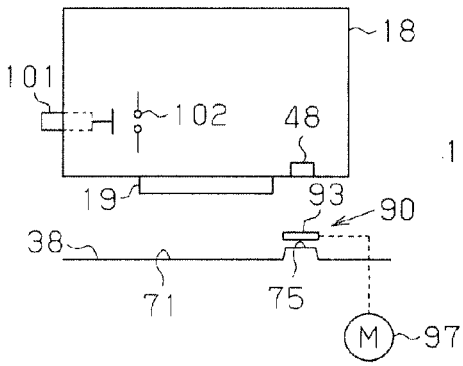
Fig. 18A
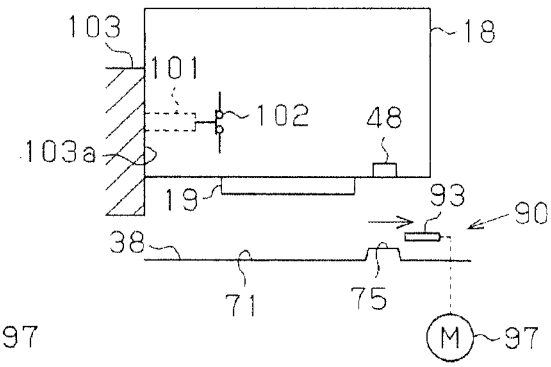
Fig. 18B

LIQUID EJECTING APPARATUS AND SENSOR SENSITIVITY SETTING METHOD IN LIQUID EJECTING APPARATUS

CROSS-REFERENCE TO RELATED APPLICATIONS

This application claims priority to Japanese Patent Application No. 2012-034855 filed on Feb. 21, 2012. The entire disclosure of Japanese Patent Application No. 2012-034855 is hereby incorporated herein by reference.

BACKGROUND

1. Technical Field

The present invention relates to a liquid ejecting apparatus provided with a function for detecting an edge position of a medium, such as a sheet of paper, by an optical sensor provided to a carriage including a liquid ejecting head, and also relates to a sensor sensitivity setting method in a liquid ejecting apparatus.

2. Background Technology

An ink jet printer has been known as this kind of liquid ejecting apparatus. Provided to the printer is a carriage which moves in a direction (main scanning direction) intersecting with a conveyance direction for sheets of paper, and which has a recording head. During printing, ink droplets are ejected from the recording head toward a sheet of paper while the carriage is being moved, whereby an image or the like is printed onto the sheet of paper (for example, Patent Documents 1 to 4, etc.).

In, for example, the printers described in Patent Documents 1 to 3, an optical sensor of a light reflection type (an edge sensor) is provided to the carriage, and a widthwise edge position of the sheet of paper is detected using the optical sensor when the carriage is moved in the main scanning direction. More specifically, a detection value from the optical sensor and a threshold value are compared against each other, and when the detection value changes to being the threshold value or lower or to being the threshold value or higher, the current position is determined to be an edge detection position (edge position) of the sheet of paper.

It has been noted that an ink mist generated when the liquid ejecting head ejects the ink droplets has been present in the vicinity of a movement path of the carriage, as has floating matter such as paper dust generated from the sheet of paper. When the floating matter becomes attached and the optical sensor is sullied, the result is a gradual decline in the amount of light received by the optical sensor, as well as changes in the amount of deviation between the actual edge position of the paper and the edge detection position from when the detection value thereof changes to being the threshold value or lower or to being the threshold value or higher. In order to resolve this, in a printer apparatus described in Patent Reference 1, a threshold value that is optimal for every iteration is re-determined for every iteration of printing, and thus it is possible to detect the edge position with high positional accuracy by using a threshold value that is optimal and has not been impacted even by aging changes in the surface state of a support base nor by aging changes caused by sullying of the optical sensor.

In the printers described in Patent Documents 2 and 3, a rib of a support base and a portion other than the rib (a groove part) are detected by an optical sensor (a recording sheet detection sensor), a detection sensitivity of the optical sensor is determined on the basis of a ratio or difference between respective detection voltages, and a threshold value corresponding to the detection sensitivity is set. For this reason, there will be a constant amount of positional deviation between the edge detection position of when the detection value of the optical sensor crosses over the threshold value and the actual edge position, and thus the edge position can be detected at high positional accuracy when corrected with a constant correction amount corresponding to the amount of positional deviation thereof.

Patent Document 4 discloses a printer having a carriage equipped with a movable shutter for closing an opening of a read sensor provided to the carriage, a means for opening and closing the shutter, and a maintaining means for maintaining the open or closed state. According to this printer, the shutter is closed when the read sensor is not in use, and thus it is possible to avoid sullying of the read sensor by the attachment of floating matter such as the ink mist.

Japanese Laid-open Patent Publication No. 2002-127521 (for example, paragraphs [0037]-[0052], FIG. 4, FIG. 5, etc.) (Patent Document 1), Japanese Laid-open Patent Publication No. 2003-260829 (for example, paragraphs [0053]-[0059], FIG. 5, FIG. 6, etc.) (Patent Document 2), Japanese Laid-open Patent Publication No. 2010-194748 (Patent Document 3), and Japanese Laid-open Patent Publication No. 11-227176 (for example, paragraphs [0023]-[0034], FIGS. 2 to 4) (Patent Document 4) are examples of the related art.

SUMMARY

Problems to be Solved by the Invention

In Patent References 2 and 3, a support surface (upper end surface) of the rib of the support base is used as a reflecting surface (a reference reflecting surface) for when the detection sensitivity of the optical sensor is to be determined. Because the rib is covered with the sheet of paper during printing and the sheet of paper slides over the support surface of the rib, the rib is easier to keep clean in comparison to the other sites on the support base. However, the rib is located in the vicinity of the liquid ejecting head, and the ink mist or paper dust is prone to be attached thereto; the attached matter causes the reflectance of the support surface of the rib to change. The reflectance of the support surface of the rib also changes because the support surface of the rib is abraded little by little by the sliding of the sheet of paper. A problem has emerged in that when the reflectance of the reference reflecting surface changes in this manner, the result is a decline in the accuracy of determining the detection sensitivity of the optical sensitivity and also the setting of an improper threshold value in response to this detection sensitivity, and there is a decline in the accuracy of detecting the edge position of the sheet of paper. In the case of the configuration described in Patent Reference 4, in which the optical sensor is protected by the movable shutter, though it is possible to avoid attachment of the ink mist, paper dust, and the like to the sensor, it is not possible to avoid sullying of a reference reflecting surface, such as the support surface of the rib, and thus the foregoing problems caused by sullying of the reference reflecting surface are not resolved.

As described above, there has been a desire for the ability to more accurately measure the sensitivity of the optical sensor. There is also a desire for the ability to ensure as much as possible the required sensitivity even despite progressive deterioration due to sullying of the optical sensor and the like.

The invention has been contrived in view of the foregoing problems, and one advantage thereof is to provide a liquid ejecting apparatus and a sensor sensitivity setting method in a liquid ejecting apparatus making it possible to keep low any fluctuations in the reflectance of a reflecting part used to measure the sensitivity of an optical sensor provided to a carriage, and to enhance the accuracy of measurement sensitivity, thus making it possible to ensure the required sensitivity even in spite of progressive deterioration of the optical sensor.

Means Used to Solve the Above-Mentioned Problems

In order to achieve the foregoing advantage, the essence of one aspect of the invention resides in being provided with: a carriage that has a liquid ejecting head for ejecting a liquid toward a medium, and moves reciprocatingly in a movement direction that intersects with a conveyance direction of the medium; an optical sensor which is provided to the carriage and has a light-emitting unit capable of irradiating light toward the medium and a light-receiving unit for receiving reflected light of the light and outputting an output value corresponding to an amount of light received; a reflecting part that is used to measure a sensitivity of the optical sensor; an openable and closable cover part for covering the reflecting part; an open/close drive unit for opening/closing the cover part; and a sensitivity setting unit for acquiring a measurement sensitivity of the optical sensor by using the output value of the light-receiving unit having received the reflected light formed when the light irradiated from the light-emitting unit is reflected by the reflecting part, in a state where the carriage is arranged at a position for causing the optical sensor to face the reflecting part and where the cover part is opened by the open/close drive unit, and for switching a sensitivity of the light-receiving unit upon determining that the measurement sensitivity is greater than an allowable limit.

According to the foregoing configuration, the cover part is in a closed state for covering the reflecting part when the reflecting part is not being used, and the reflecting part is protected from floating matter, such as a liquid mist or a medium dust generated by friction on the medium or the like. For this reason, attachment of the floating matter onto the reflecting part is avoided. There is no concern that the reflecting part, which is protected by the cover part, might be abraded by sliding of the medium. Accordingly, the reflectance of the reflecting part is kept at a comparatively more stabilized value less susceptible to fluctuation. When the sensitivity of the light-receiving unit is to be measured, the cover part, which theretofore was in the closed state for covering the reflecting part, is opened by the open/close drive unit. The sensitivity setting unit acquires the measurement sensitivity by using the output value of the light-receiving unit having received the reflected light formed when the light irradiated from the light-emitting unit is reflected by the reflecting part, in a state where the carriage is arranged at a position for causing the optical sensor to face the reflecting part and where the cover part is opened by the open/close drive unit, and switches the sensitivity of the light-receiving unit upon determining that the acquired measurement sensitivity is greater than the allowable limit. Herein, because the reflectance of the reflecting part protected by the cover part is comparatively stable, the measurement sensitivity using the output value of the light-receiving unit having received the light reflected by the reflecting part will be more properly reflective of the extent of degradation caused by sullying of the optical sensor and the like. Accordingly, it is possible to keep low any fluctuations in the reflectance of the reflecting part used to measure the sensitivity of the optical sensor provided to the carriage, and to enhance the accuracy of the measurement sensitivity, thus making it possible to ensure the required sensitivity even in spite of progressive deterioration of the optical sensor.

In a liquid ejecting apparatus of one aspect of the invention, preferably, the open/close drive unit is provided with an engaged part with which the carriage can engage while in the process of moving, as well as with an urging unit for urging the cover part in a closing direction, and is configured so as to resist an urging force of the urging unit and move the cover part in an opening direction, powered by a force from when the carriage presses on the engaged part.

According to the foregoing configuration, the cover part resists the urging force of the urging unit and is opened powered by the force of when the carriage presses on the engaged part while in the process of moving and the engaged part is displaced. Accordingly, it is possible to open the cover at the time of a sensitivity setting performed by moving the carriage to a setting position, even when an open/close drive unit having a power source is not adopted. For this reason, the addition of a power source can be avoided, and moreover the increase of processing burden in a control unit for controlling the power source during opening/closing of the cover can also be avoided.

In a liquid ejecting apparatus of one aspect of the invention, preferably, the open/close drive unit is provided with a power source for outputting power for opening/closing the cover part, and a control unit for controlling the power source and causing the cover part to be opened/closed.

According to the foregoing configuration, the control unit controls the power source and the cover part is opened at the time of the sensitivity setting. Also, after the reflected light of the light with which the reflecting part is irradiated is received by the light-receiving unit and the output value is acquired, the control unit controls the power source to close the cover part. Because of the configuration where the control unit controls the power source to open/close the cover unit, the degree of freedom in the arrangement position of the reflecting part is enhanced and, for example, a reduction in size of the liquid ejecting apparatus becomes possible, in comparison to a mechanical configuration where the cover part is opened by the force of the carriage pressing on the engaged part.

In a liquid ejecting apparatus of one aspect of the invention, preferably, further provided is a detection unit for detecting an edge position of the medium, the output value being a first output value and the detecting unit using a second output value outputted by the light-receiving unit having received reflected light of the light irradiated by the light-emitting unit while the carriage is in the process of being moved in the movement direction, in a state where the medium is arranged at a position in the conveyance direction permitting detection by the optical sensor.

According to the foregoing configuration, in a state where the light-receiving unit has been set to a proper sensitivity, the detection unit detects the edge position of the medium by using the second output value outputted by the light-receiving unit having received the reflected light of the light irradiated by the light-emitting unit toward the medium while the carriage is in the process of being moved in the movement direction, in a state where the medium is arranged at a position in the conveyance direction permitting detection by the optical sensor. For this reason, a comparatively higher accuracy of detecting the edge position of the medium can be maintained, even despite the degradation caused by the sullying of the optical sensor and the like.

In a liquid ejecting apparatus of one aspect of the invention, preferably, the setting of the sensitivity by the sensitivity setting unit is carried out at a timing of when the liquid ejecting apparatus is powered on and/or of when the number of media having undergone liquid ejection treatment by the liquid ejecting head reaches a setting value.

According to the foregoing configuration, the carriage is moved to the setting position and the setting of the sensitivity by the sensitivity setting unit is carried out at the timing of when the liquid ejecting apparatus is powered on and/or of when the number of media having undergone the liquid ejecting treatment by the liquid ejecting head reaches the setting value. Accordingly, the moving of the carriage to the setting position for the purpose of setting the sensitivity is limited to a proper timing where the optical sensor has been sullied a certain extent, and it is possible to set the light-receiving unit of the optical sensor to a proper sensitivity while also avoiding unneeded movement of the carriage to the setting position, which would cause a decline in the throughput of the liquid ejecting treatment.

In a liquid ejecting apparatus of one aspect of the invention, preferably, the reflecting part is arranged on the outside of a liquid ejecting region where the liquid is ejected from the liquid ejecting head. According to the foregoing configuration, because the reflecting part is arranged on the outside of the liquid ejecting region, floating matter such as the medium dust or the mist generated when the liquid is ejected onto the medium is less prone to attach to the cover part. For example, during opening/closing of the cover part, it is possible to avoid an event where some of the attached matter falls through and sullies the reflecting part. Also, in a case of a configuration where the open/close drive unit is mechanical, it is possible to avoid a situation where the carriage engages with the engaged part upon moving through the liquid ejecting region in order to eject the liquid onto the medium, and results in the cover part being opened.

In a liquid ejecting apparatus of one aspect of the invention, preferably, the output value being a first output value, the sensitivity setting unit acquires a third output value outputted by the light-receiving unit having received reflected light formed when the light irradiated from the light-emitting unit is reflected by a support unit for supporting the medium, and carries out the sensitivity setting by using the first output value and the third output value.

According to the foregoing configuration, because the sensitivity measurement is carried out using the first output value and the third output value, a more highly accurate measurement sensitivity can be acquired. Accordingly, the sensitivity of the light-receiving unit can be switched to a proper sensitivity at a proper timing.

The essence of one aspect of the invention resides in being a sensor sensitivity setting method in a liquid ejecting apparatus, wherein the method includes: a cover opening step for opening a cover part for covering in an openable and closable state a reflecting part used to measure a sensitivity of an optical sensor provided to a carriage having a liquid ejecting head; a sensitivity measurement step for measuring the sensitivity in a state where the carriage has been arranged at a position where a light-emitting unit and light-receiving unit of the optical sensor face the reflecting part, by using an output value of the light-receiving unit having received reflected light formed when light irradiated from the light-emitting unit is reflected by the reflecting part; and a sensitivity setting step for setting the light-receiving unit to a sensitivity corresponding to the measurement sensitivity in the sensitivity measurement step. According to the foregoing method, an effect similar to that of the invention relating to the liquid ejecting apparatus can be obtained.

BRIEF DESCRIPTION OF THE DRAWINGS

Referring now to the attached drawings which form a part of this original disclosure:

FIG. 16 is a partially cutaway schematic front view illustrating a support base and a cover unit in a second embodiment;

FIGS. 17A and 17B are schematic side cutaway views illustrating an opening/closing operation of a cover unit; and FIGS. 18A and 18B are schematic front views illustrating an opening/closing operation of a cover unit in a modification example.

DETAILED DESCRIPTION OF EXEMPLARY EMBODIMENTS

First Embodiment

What follows is a description of a first embodiment, in which the liquid ejecting apparatus of the invention is embodied as an ink jet printer, with reference to FIGS. 1 to 15.

Figure 1:
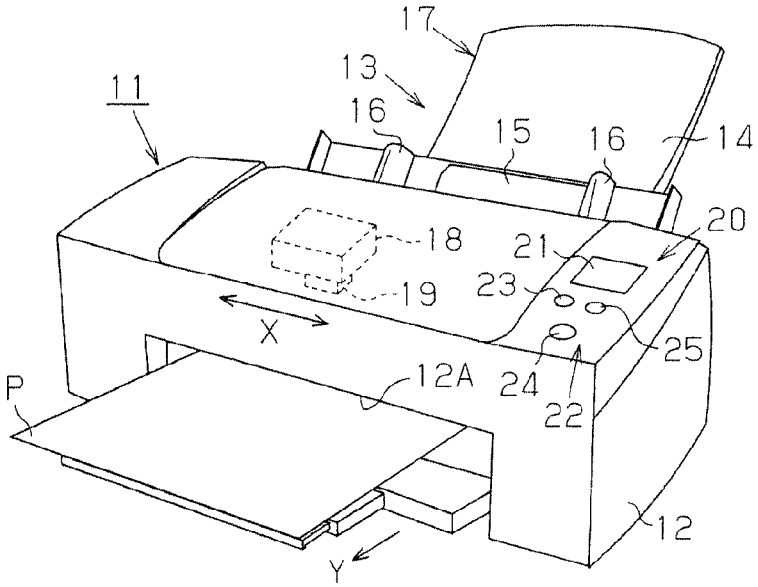
FIG. 1 is a perspective view of a printer in a first embodiment.

As illustrated in FIG. 1, the ink jet printer which is one example of the liquid ejecting apparatus (hereinafter, simply called a "printer 11") is equipped with an auto sheet feeder device 13 for conveying a sheet of paper P (sheet), serving as one example of medium, at the rear side of a main body 12. The auto sheet feeder device 13 is provided with a sheet feeder tray 14, a hopper 15, and a paper sheet guide 17 having edge guides 16, and feeds sheets of paper having been set into the paper sheet guide 17 one sheet at a time to the inside of the main body 12. The left/right pair of edge guides 16 guide a sheet of paper P in the width direction, centered on a widthwise middle position of the sheet feeder tray 14.

Inside of the main body 12, a carriage 18 is provided in a state allowing reciprocating movement in a movement direction X (main scanning direction) along a movement path thereof, and a liquid ejecting head 19 is attached at a lower part of the carriage 18. Substantially in alternation, the printer 11 repeats a recording operation, in which ink droplets are ejected onto the surface of the sheet of paper P from the liquid ejecting head 19 while the carriage 18 is in the process of moving in the movement direction X, and a sheet feed operation, in which the sheet of paper P is conveyed by a requested conveyance amount in a conveyance direction Y (a secondary scanning direction) intersecting with the movement direction X; an image, text, or the like based on given print data is printed onto the sheet of paper P. The sheet of paper P after printing is discharged from a sheet discharge port 12A opening on a front side lower part of the main body 12.

An operation panel 20 is also provided to an upper surface end part of the main body 12. Provided to the operation panel 20 are a display unit 21, including a liquid crystal display panel or the like, and an operation switch 22. Provided to the operation switch 22 are a power source switch 23, a print start switch 24, a cancel switch 25, and the like. The display unit 21 may be a touch panel.

Figure 2:
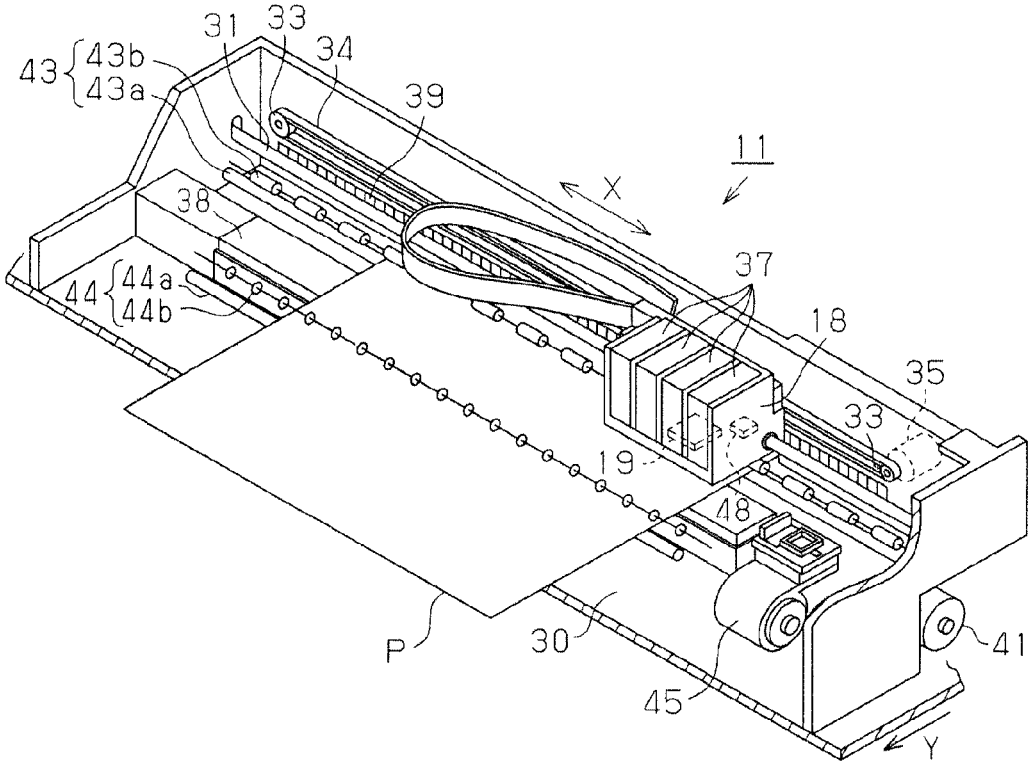
FIG. 2 is a perspective view illustrating a configuration of a printer.

Next, the internal configuration of the printer 11 shall be described. As is illustrated in FIG. 2, the printer 11 has a substantially quadrangular box-shaped main body frame 30, the upper side and front side of which are open; the carriage 18 is attached in a state allowing reciprocating movement in the main scanning direction X at a guide shaft 31, which is bridged between left and right side walls of the main body frame 30 in FIG. 2. An endless timing belt 34 is wound about a pair of pulleys 33 mounted onto an inner surface of a back plate of the main body frame 30, and the carriage 18 is fixed to a part of the timing belt 34. Coupled to the right-side pulley 33 in FIG. 2 is a drive shaft (output shaft) of a carriage motor 35; when the carriage motor 35 is driven forward and in reverse and the timing belt 34 turns forward and in reverse, the carriage 18 is thereby moved reciprocatingly in the movement direction X (the main scanning direction).

A plurality (for example, four) of ink cartridges 37 in which different colors of ink (for example, the four colors of black (K), cyan (C), magenta (M), and yellow (Y)) are respectively contained are loaded into an upper part of the carriage 18. Ink that is supplied from each of the ink cartridges 37 is respectively ejected from nozzles in a corresponding nozzle row NA (see FIG. 5), there being the same number of nozzle rows formed on the liquid ejecting head 19 (in the present example, four) as there are colors of ink. A support base 38, serving as one example of a support unit, for regulating the interval (gap) between the liquid ejecting head 19 and the sheet of paper P is provided to a position below the movement path of the carriage 18 so as to extend in the main scanning direction X. The ink colors that can be ejected by the liquid ejecting head 19 need not be four in number; there may also be one color, three colors, or five to eight colors.

A linear encoder 39 for outputting a number of pulses that is proportional to an amount of travel by the carriage 18 is provided to a back surface side of the carriage 18 so as to extend along the guide shaft 31. In the printer 11, positional control and speed control of the carriage 18 are carried out on the basis of a pulse signal that is outputted from the linear encoder 39.

A conveyance motor 41 is disposed at a right-side lower part in FIG. 2 of the main body frame 30. A sheet feeder roller (not shown) is driven by the power of the conveyance motor 41, whereby the sheets of paper P that have been set into the sheet feeder tray 14 (see FIG. 1) are fed out one sheet at a time. A conveyor roller pair 43 and a discharge roller pair 44 are arranged on a downstream side and upstream side thereof, respectively, sandwiching the support base 38 in the conveyance direction Y. Each of the roller pairs 43, 44 includes a drive roller 43*a*, 44*a* that is rotated by the power of the conveyance motor 41 and a driven roller 43*b*, 44*b* that turns together with the rotation of the drive roller 43*a*. When the conveyance motor 41 is driven, the sheet of paper P is thereby conveyed in the conveyance direction Y (the secondary scanning direction) in a state of being sandwiched (nipped) between the two roller pairs 43, 44.

In FIG. 2, a position at one end on the movement path of the carriage 18 (in FIG. 2, this is the rightmost position) serves as a home position at which the carriage 18 remains on standby when printing is not taking place. A maintenance device 45 for cleaning and otherwise maintaining the liquid ejecting head 19 is disposed directly below the carriage 18 arranged at the home position. In the present embodiment, the conveyance motor 41 also serves as a source of power for the maintenance device 45. In addition, a sheet width sensor 48, serving as one example of an optical sensor, for detecting the ends (edges) on both sides of the sheet of paper P in the width direction (the movement direction X) is provided to the carriage.

Figure 5:
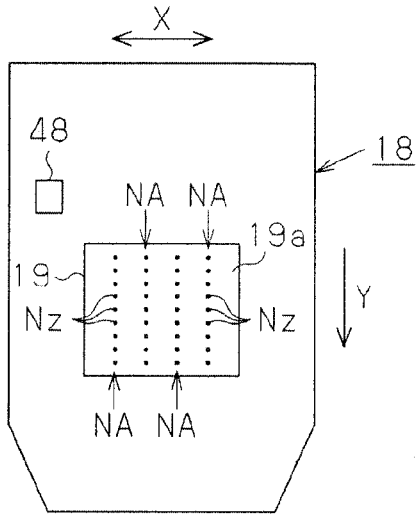
FIG. 5 is a bottom view of a carriage.

FIG. 5 illustrates the bottom of the carriage. A plurality of nozzle rows NA, formed by a plurality of nozzles Nz being arrayed at a constant pitch in the conveyance direction Y in a state where the carriage 18 has been assembled in the printer 11, are arrayed at a predetermined spacing in the movement direction X on a nozzle formation surface 19*a* of the liquid ejecting head 19, which is attached to a substantially middle position of the bottom of the carriage 18. The ink that is supplied from the corresponding ink cartridge 37 is ejected from the nozzles Nz constituting the nozzle rows NA. The sheet width sensor 48 is attached on the bottom of the carriage 18 to a position farther on the upstream side in the conveyance direction Y than the liquid ejecting head 19.

Figures 3A, 3B:
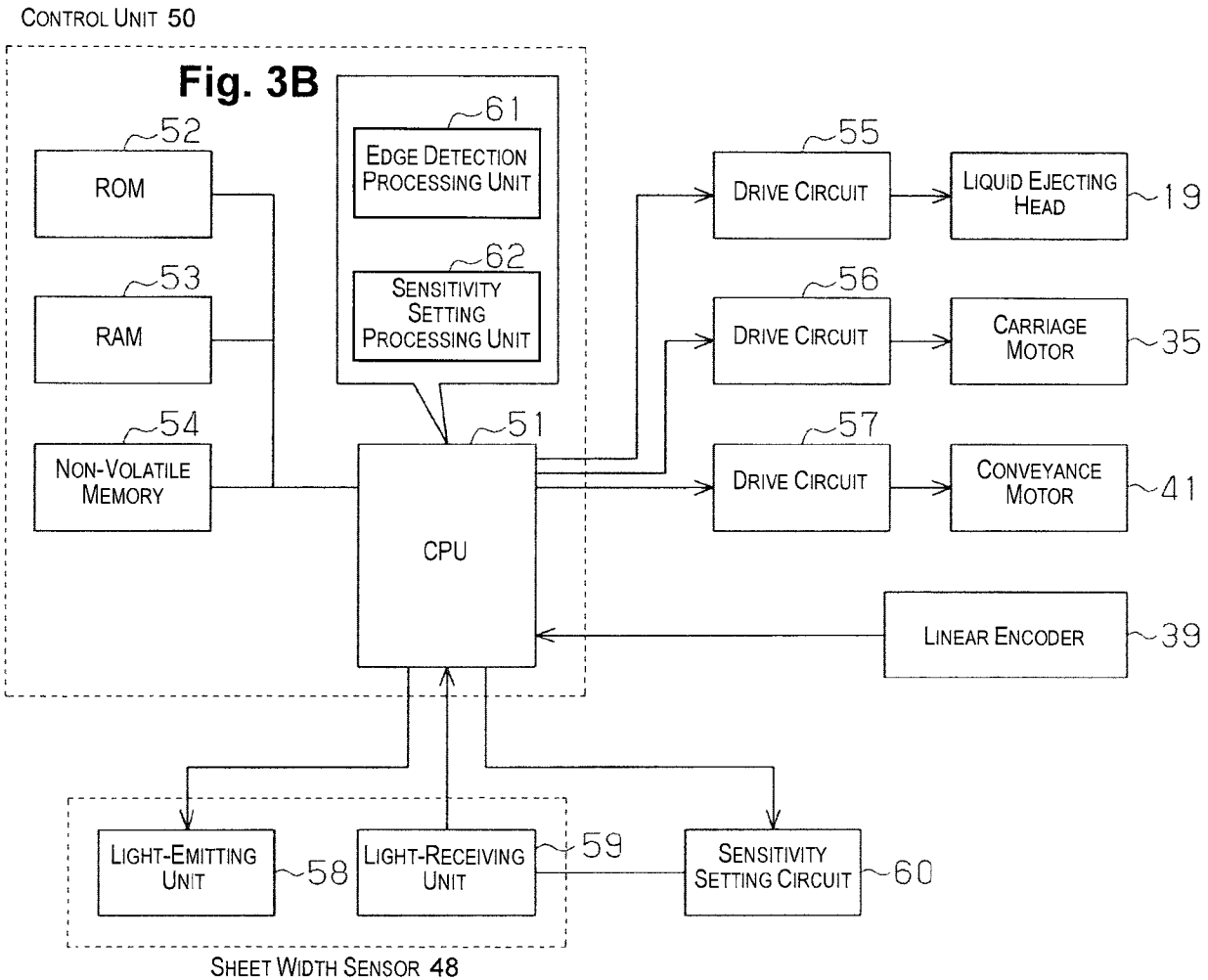
FIG. 3A is a block diagram illustrating an electrical configuration of a printer.
FIG. 3B is a block diagram illustrating a functional configuration of a control unit.

The electrical configuration of the printer 11 shall now be described on the basis of FIGS. 3A and 3B. The printer 11 illustrated in FIGS. 3A and 3B is provided with a control unit 50 for governing the overall control thereof. The control unit 50 is constituted of, for example, a computer (a microcomputer), and is provided with a CPU 51 (a central processing unit), a ROM 52, a RAM 53, and a non-volatile memory 54. The ROM 52 stores a variety of types of programs. Some programs, setting data for when a variety of types of programs are to be executed, and the like are stored in the non-volatile memory 54, which also retains the stored contents even when the power is turned off. The CPU 51 controls the print operation of the printer 11 and the like by executing programs stored in the ROM 52 and in the non-volatile memory 54. An application specific integrated circuit (ASIC) may also be added, with the data processing needed for drive control of the liquid ejecting head 19 and the like then being performed by the ASIC.

The control unit 50 drives and controls the liquid ejecting head 19 via a drive circuit 55 on the basis of print data, and causes ink to be ejected from the liquid ejecting head 19. The control unit 50 also drives and controls the carriage motor 35 via a drive circuit 56, and causes the carriage 18 to move reciprocatingly in the movement direction X. The control unit 50 further drives and controls the conveyance motor 41 via a drive circuit 57, and causes the sheet of paper P to be conveyed in the conveyance direction Y. The control unit 50 detects a position of the carriage 18 (carriage position) in the movement direction X, with the home position as the point of origin, on the basis of a pulse signal inputted from the linear encoder 39. More specifically, the control unit 50 is provided with a counter for using the point in time where the carriage 18 is at the home position as the point of origin to count the number of pulse edges of the pulse signal inputted from the linear encoder 39, and increments the count of the counter upon forward movement of the carriage 18 and decrements the count upon return movement of the carriage 18. For this reason, the count of the counter is indicative of the position of the carriage 18 in the movement direction X (the carriage position).

The sheet width sensor 48, which is connected to the control unit 50, is provided with a light-emitting unit 58 for irradiating light towards the support base 38 (downward in the vertical direction) and a light-receiving unit 59 for receiving reflected light of the light irradiated from the light-emitting unit 58. The control unit 50 controls the light emission from the light-emitting unit 58, and receives the input of an output voltage corresponding to the amount of light received thereby from the light-receiving unit 59. The control unit 50 is connected to a sensitivity setting circuit 60 for setting the sensitivity of the light-receiving unit 59, and the sensitivity of the light-receiving unit 59 is adjusted by altering the sensitivity setting value in the sensitivity setting circuit 60.

FIG. 3B illustrates a functional configuration which functions by the CPU 51 executing a program that is read from the ROM 52 or the non-volatile memory 54. As a function unit for functioning by the CPU 51 executing a program, the control unit 50 is provided with an edge detection processing unit 61 as well as with a sensitivity setting processing unit 62, serving as one example of a sensitivity setting unit.

The edge detection processing unit 61 detects the position of a widthwise edge of the sheet of paper P on the basis of the output voltage inputted from the light-receiving unit 59. That is, the edge detection processing unit 61 compares the output voltage of the sheet width sensor 48 and a threshold value, detects the edge of the sheet of paper P in response to crossing of the output voltage over the threshold value, and acquires the position of the sheet width sensor 48 at the time of this detection, as the edge position (edge position) of the sheet of paper P. More specifically, the position of the sheet width sensor 48 is ascertained on the basis of the position of the carriage 18 in the width direction X (the carriage position) as ascertained on the basis of the pulse signal of the linear encoder 39 and of the known distance between this carriage position and the position of the sheet width sensor 48 in the movement direction X. The edge detection processing unit 61, upon detecting the edge of the sheet of paper P in response to the crossing of the output voltage of the sheet width sensor 48 over the threshold value, acquires the position of the sheet width sensor 48 at that time, i.e., an edge detection position Xd (edge detection position) of the sheet of paper P, on the basis of the count of the counter for counting the position of the carriage 18 and the aforementioned known distance (a counter conversion value). The edge detection processing unit 61 acquires an edge position Xe (edge position) by correcting the edge detection position Xd with a correction amount dx (Xe=Xd+dx).

The sensitivity setting processing unit 62 applies to the sensitivity setting circuit 60 a control signal corresponding to a setting value, and thus sets the sensitivity of the light-receiving unit 59. In the case of a determination that the sheet width sensor 48 has been sullied due to attachment of floating matter, such as the ink mist or the paper dust, or the like, and that the edge position detection sensitivity has decreased beyond an allowable range, the sensitivity setting processing unit 62 then alters the setting value of the sensitivity setting circuit 60 and alters the sensitivity of the light-receiving unit 59 so as to be higher.

Figure 4:
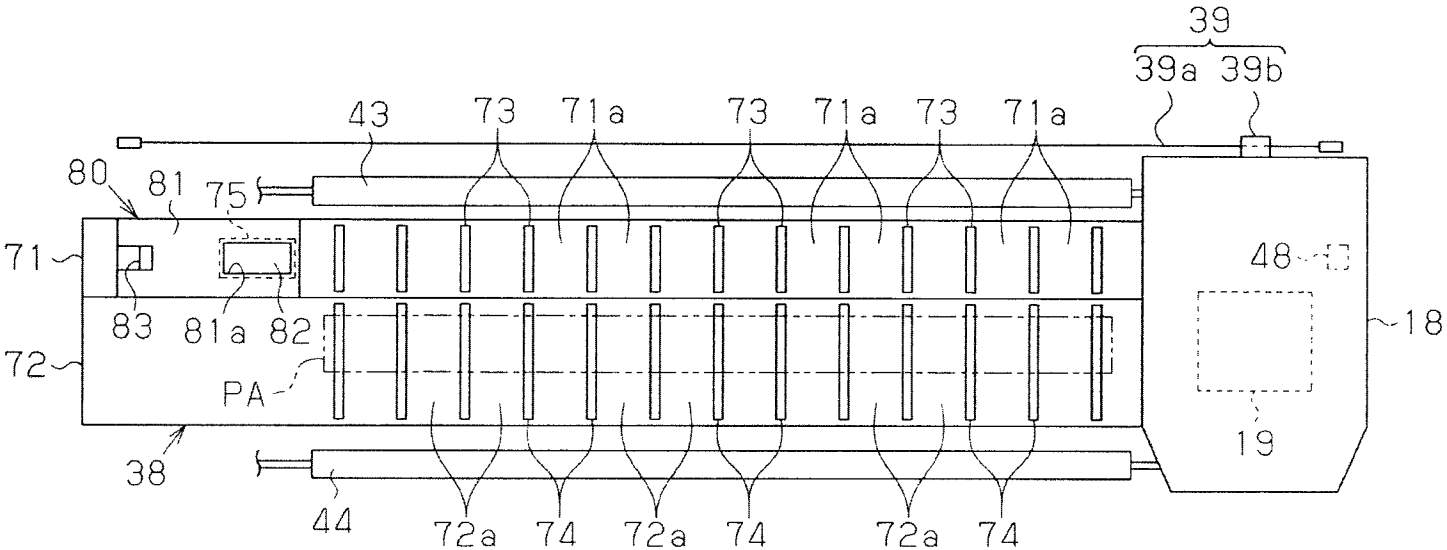
FIG. 4 is a schematic plan view illustrating a carriage, a support base, and so forth.

FIG. 4 illustrates the support base and the carriage. Formed on the support base 38 are an upstream support surface located on the upstream side in the conveyance direction Y and a downstream support surface 72 located on the downstream side in the conveyance direction Y with respect to the upstream support surface 71. Upstream ribs 73 that project out upward in the vertical direction (the front side of the plane of the paper in FIG. 4) and extend in the conveyance direction Y are formed on the upstream support surface 71. Downstream ribs 74 that project out upward in the vertical direction and extend in the conveyance direction Y are formed on the downstream support surface 72. From the lower side in the vertical direction, both the upstream ribs 73 and the downstream ribs 74 support the sheet of paper P being conveyed, and the sheet of paper P illustrated in FIG. 2 is conveyed along the upstream ribs 73 and the downstream ribs 74.

As illustrated in FIG. 4, groove parts 71*a* which have a lower bottom that an uppermost surface of the upstream ribs 73 are formed on portions other than the upstream ribs 73 in the upstream support surface 71. Also, groove parts 72*a* which have a lower bottom that an uppermost surface of the downstream ribs 74 are formed on portions other than the downstream ribs 74 in the downstream support surface 72.

In FIG. 4, the right edge position at which the carriage 18 is located serves as the home position. A liquid ejecting region PA (print region), which is the maximum area where the liquid ejecting head 19 is able to eject ink drops for printing in the movement direction X of the carriage 18, is located atop the downstream support surface 72, as illustrated by the two-dot chain line in FIG. 4.

A reference reflecting surface 75 is formed at a position that is further outward in the movement direction X (further toward an anti-home position) than the liquid ejecting region PA in the upstream support surface 71. The reference reflecting surface 75 is a reflecting surface that serves as a reference for when the amount of sullying of the sheet width sensor 48 is studied from the value of the output voltage of the light-receiving unit 59 receiving the reflected light that has been irradiated from the light-emitting unit 58 and reflected, and is finished to a flat mirror surface that is parallel with the nozzle formation surface 19*a* of the liquid ejecting head 19. The plane direction of the reference reflecting surface 75 is orthogonal to the irradiation direction of the light-emitting unit 58 (the vertically downward direction).

A cover unit 80 for covering the reference reflecting surface 75 is provided to an edge of the anti-home position side of the upstream support surface 71. The cover unit 80 is provided with: a cover body 81, assembled in a state surrounding a predetermined area that includes the reference reflecting surface 75; a cover part 82 (shutter unit) for opening/closing a quadrangular window unit 81*a* opening on the upper surface side of the cover body 81; and a lever unit 83, serving as one example of an engaged part, which is interlocked with the cover part 82 and is used in an operation for moving the cover part 82 in an opening/closing direction. The cover part 82 is enabled to slide between a closed position for covering the reference reflecting surface 75 and an open position for allowing the reference reflecting surface 75 to be exposed from the window unit 81*a*. In a case where the extent of sullying of the sheet width sensor 48 (degree of sullying) is to be studied, it is necessary to eliminate the factors whereby the reflectivity of the reference reflecting surface 75 fluctuates. In view whereof, the reference reflecting surface 75 is covered with the cover unit 80, and the cover part 82 is opened to expose the reference reflecting surface 75 only when used to study the degree of sullying of the sheet width sensor 48. In the present embodiment, the sensitivity of the sheet width sensor 48 is switched so as to be higher in a stepwise manner every time a determination value indicative of the degree of sullying of the sheet width sensor 48, which is found on the basis of the output voltage of the sheet width sensor 48 (reference surface voltage) receiving the light reflected by the reference reflecting surface 75, satisfies a pre-established sensitivity switching condition. Herein, the degree of sullying is meant to be indicative of the extent of degradation caused by sullying of the sheet width sensor 48 (the extent of the decrease in detection sensitivity), and the measurement of the degree of sullying is equivalent to the measurement of the detection sensitivity.

The lever unit 83, which projects out upward in the vertical direction on the cover unit 80 illustrated in FIG. 4, is arranged at a position enabling engagement with the carriage 18 just before the carriage 18, which moves toward the anti-home position, arrives at a setting position where the sheet width sensor 48 can face the reference reflecting surface 75. For this reason, having begun to move from the home position side, the carriage 18 engages the lever unit 83 just before arriving at the setting position on the anti-home position side, and pushes in on the lever unit 83 toward the opening direction of the cover part 82. Then, when the carriage 18 stops at the setting position, the operation of pushing in on the lever unit 83 causes the cover part 82 to slide from the closed position to the open position; below the sheet width sensor 48, the reference reflecting surface 75 exposed via the window unit 81*a* by which the cover part 82 is opened is positioned so as to be facing. A more detailed description of the configuration of the cover unit 80 shall be provided below.

Being arranged at an edge of the upstream support surface 71, which is located further on the upstream side in the conveyance direction Y than the downstream support surface 72, at which the liquid ejecting region PA (print region) is located, in the support base 38, the reference reflecting surface 75 is therefore located on the outside of the liquid ejecting region PA in both the conveyance direction and the movement direction X. For this reason, attachment of the ink mist to the surface of the cover unit 80 for covering the reference reflecting surface 75 is relatively curbed. This avoids a situation where small pieces of deposited dry matter from the ink mist, deposited matter from the paper dust, or the like fall through the window unit 81*a* when the cover part 82 is opened and foul the reference reflecting surface 75.

As illustrated in FIG. 4, the linear encoder 39 is provided with: a linear scale 39*a* on which a plurality of slits (not shown) are formed at a constant pitch in the movement direction X; and a sensor 39*b* that is attached to the carriage 18 so as to be able to move along the linear scale 39*a*. The sensor 39*b* is provided with a light-emitting unit and a light-receiving unit; light that is irradiated from the light-emitting unit passes through the slits of the linear scale 39*a* and is received by the light-receiving unit, which outputs a pulse signal of a number of pulses that is proportional to the distance of movement of the carriage 18.

The sheet of paper P, which is positioned in the width direction by the pair of edge guides 16 illustrated in FIG. 1, is fed out so that the width center thereof passes through a widthwise middle position of the conveyance path. For this reason, the position of the edge (edge position) of both sides of the sheet of paper in the width direction when the paper has been conveyed over the support base 38 in FIG. 4 is determined by the width of the sheet of paper P. In the present embodiment, the position of each of the upstream ribs 73 in the movement direction X is set for a sheet of paper P of a prescribed size so that the two edge positions thereof in the width direction are positioned to face the groove parts 71*a*. Because of this, the two widthwise edges of the sheet of paper P having been conveyed over the support base 38 are positioned to face the groove parts 71*a* at all times.

Figure 6:
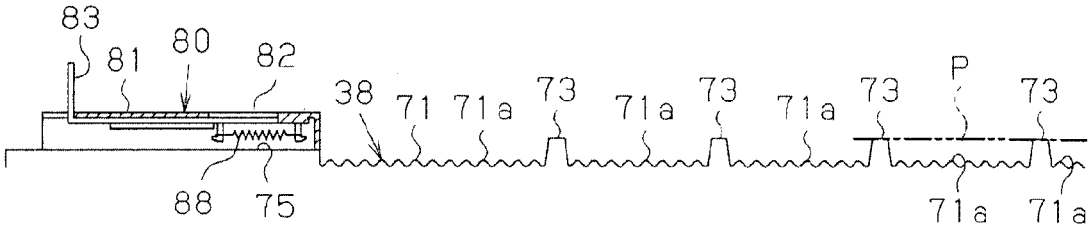
FIG. 6 is a partial cutaway schematic front view illustrating a support base and a cover unit.

As illustrated in FIG. 6, the bottom of the groove parts 71*a* is formed to be a relatively fine, wavy surface, and light that is irradiated substantially perpendicularly to the groove parts 71*a* from the light-emitting unit 58 is more prone to scattered reflection. For this reason, a lesser amount of light that is reflected by the groove parts 71*a* is received by the light-receiving unit 59, and the output voltage thereof is correspondingly larger. The output voltage of the light-receiving unit 59 receiving the reflected light from the sheet of paper P is also correspondingly smaller. In the present embodiment, the threshold value is set to be between the output voltage of the light-receiving unit 59 for when the reflecting surface of the light irradiated from the light-emitting unit 58 is the groove parts 71*a* and the output voltage of the light-receiving unit 59 for when the reflecting surface is the sheet of paper P. Then, the edge of the sheet of paper P in the width direction is detected in response to the crossing of the output voltage of the light-receiving unit 59 over the threshold value. Then, the edge position (edge position) of the sheet of paper P in the width direction is detected from the position of the sheet width sensor 48 at the point in time where the edge of the sheet of paper P was detected. The edge detection processing unit 61 (see FIGS. 3A and 3B) also acquires the edge position of the sheet of paper P by correcting the edge position of the sheet of paper P with a correction amount. Such processing for detecting the edge position of the sheet of paper P is performed by the edge detection processing unit 61.

Figure 7:
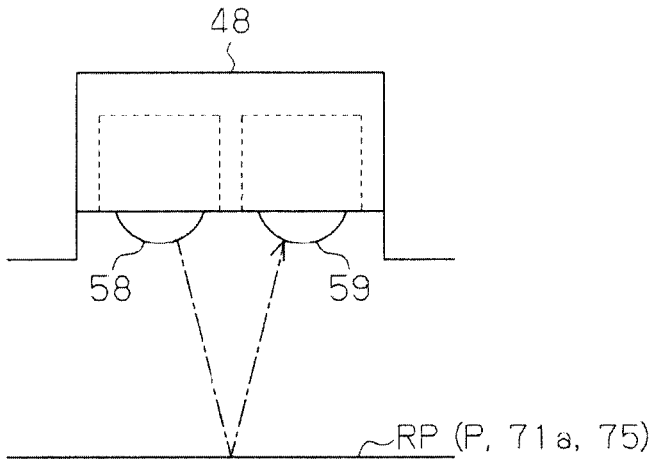
FIG. 7 is a schematic front view illustrating a sheet width sensor.

The sheet width sensor 48, which is fixed to a side opposite to the support base 38 (the lower surface side) on the carriage 18, as illustrated in FIG. 7, is attached in a relatively close state where the light-emitting unit 58 and the light-receiving unit 59 are adjacent to each other. The distance between the optical axes of the light-emitting unit 58 and the light-receiving unit 59 is very short, and light that is irradiated vertically downward from the light-emitting unit 58 is reflected by a reflecting surface RP of an object intended to be irradiated with light, where reflected light reflected substantially vertically upward is received by the light-receiving unit 59. In FIG. 7, the optical paths of the irradiated light and the reflected light are schematically illustrated with obliquely extending one-dot chain lines, but the actual irradiated light and actual reflected light can be approximated as a column of light that extends in a substantially vertical direction, having been condensed by a condenser lens. The reflecting surface RP of the object intended to be irradiated with light could be the surface of the sheet of paper P, the groove parts 71*a*, the reference reflecting surface 75, and so forth.

Figure 8:
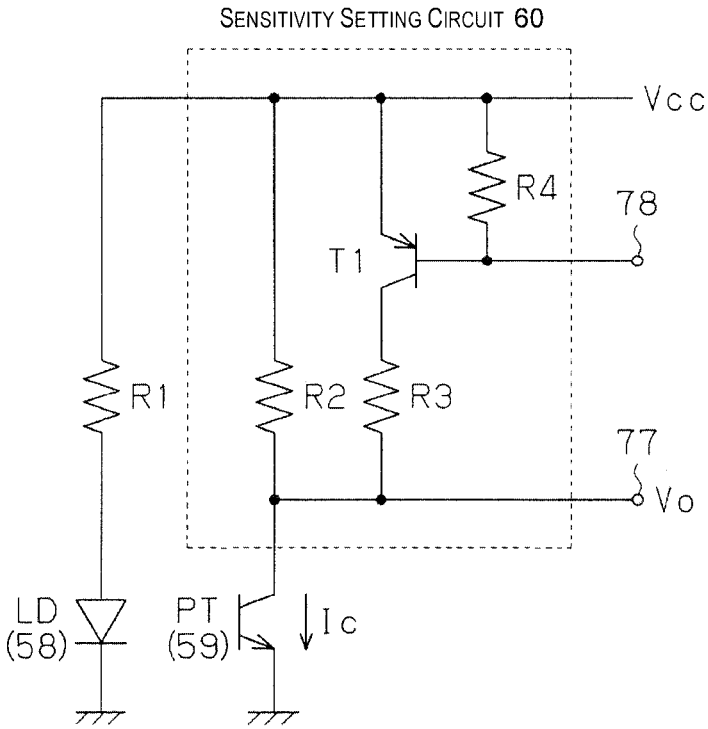
FIG. 8 is a circuit diagram illustrating a sheet width sensor and sensitivity setting circuit.

The circuitry configuration of the sensitivity setting circuit 60 shall now be described, on the basis of FIG. 8. As illustrated in FIG. 8, a cathode of a light-emitting diode LD, which is the light-emitting unit 58, is grounded, and an anode of the light-emitting diode LD is connected to one end of a resistor R1, a power source voltage Vcc is applied to the other end of the resistor R1.

When light is received by a phototransistor PT, which is the light-receiving unit 59, a photocurrent Ic flows between a collector and emitter of the phototransistor PT, and an output voltage V0 is detected at a terminal unit 77 that is connected to the collector of the phototransistor PT.

The emitter of the phototransistor PT is grounded, and the collector of the phototransistor PT is connected to one end of a resistor R2; the power source voltage Vcc is applied to the other end of the resistor R2. The collector of the phototransistor PT is also connected to one end of a resistor R3, and a collector of a transistor T1 is connected to the other end of the resistor R3.

The power source voltage Vcc is applied to an emitter of the transistor T1, and a base of the transistor T1 is connected to one end of a resistor R4; the power source voltage Vcc is applied to the other end of the resistor R4.

A terminal unit 78 is connected to the base of the transistor T1. The CPU 51 applies a control signal to the base of the transistor T1 via the terminal unit 78, and causes the collector and the emitter of the transistor T1 to undergo a switching operation between a conductive state and a non-conductive state. When the collector and the emitter of the transistor T1 are in a conductive state, a current flows to the collector of the phototransistor PT via the resistor R2 and the resistor R3. When the collector and the emitter of the transistor T1 are in a non-conductive state, a current flows to the collector of the phototransistor PT via only the resistor R2.

The sensitivity setting circuit 60 is configured to include the resistors R2, R3, and R4 as well as the transistor T1. The sensitivity of the light-receiving unit 59, which includes the phototransistor PT, is set by the sensitivity setting processing unit 62 illustrated in FIGS. 3A and 3B (the CPU 51) applying a control signal corresponding to a setting value to the base of the transistor T1 inside the sensitivity setting circuit 60, via the terminal unit 78. As an example, a pulse width modulation (PWM) signal is used as the control signal; by altering the setting value, the sensitivity setting processing unit 62 switches the duty ratio, which is the ratio of the pulse width to the period of a PWM signal outputted by a PWM generation circuit (not shown) inside the control unit 50, and thus switches the sensitivity of the light-receiving unit 59 in a plurality of stages (for example, three stages). In the present embodiment, an emitted light amount setting circuit (not shown) for setting the amount of light emitted by the light-emitting unit 58 is also provided; when, after the sensitivity of the light-receiving unit 59 has been set to the highest sensitivity of the final stage, an allowable limit is reached even with this sensitivity, then the amount of light emitted by the light-emitting unit 58 is increased in a stepwise manner, whereby the range of the degrees of sullying with which the edge of the sheet of paper P can be detected is widened. The number of stages for switching the sensitivity of the light-receiving unit 59 and the amount of light emitted by the light-emitting unit 58 can be set as appropriate, and the switching may be of a plurality of stages, for example, a two-stage switch, a four-stage switch, or more. The configuration may also be such that the resistance values of the resistors inside the sensitivity setting circuit 60 are continuously changing, with the sensitivity of the light-receiving unit 59 also continuously changing.

Figure 9A:
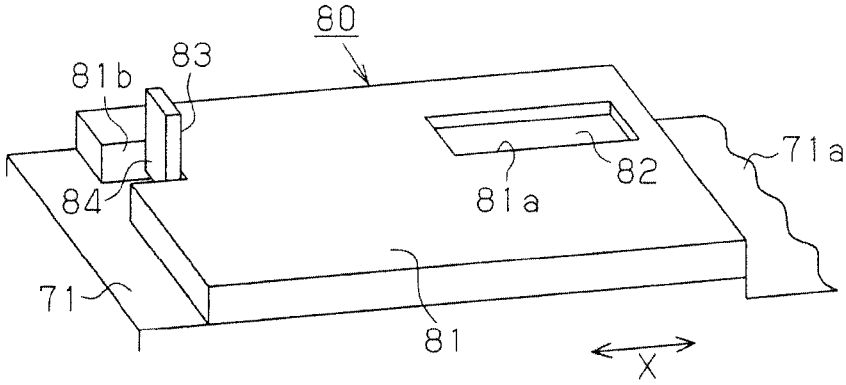
FIGS. 9A and 9B are perspective views illustrating an opening/closing operation of a cover unit.
Figure 9B:
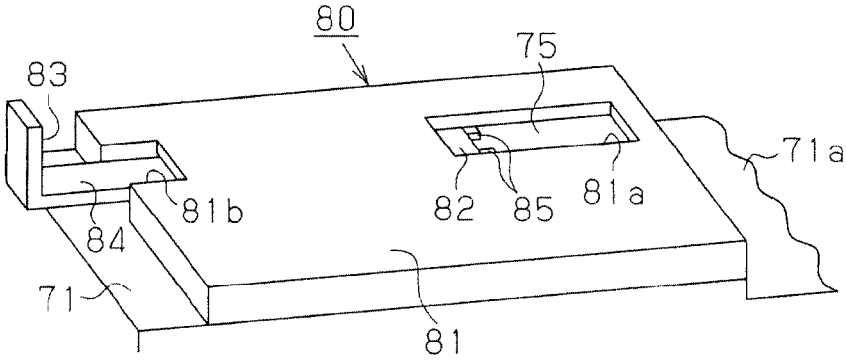

As illustrated in FIGS. 9A and 9B, the cover body 81 has a flat, substantially rectangular box shape, where the bottom, which faces the downstream support surface 72 of the support base 38, is opened. The cover part 82 and the lever unit 83 are formed each at two edges of a slider 84 in the movement direction X, the slider having a substantially L-shaped cross-section and being able to slide along the movement direction X of the carriage (in FIGS. 9A and 9B, this is the left/right direction) through the inside of the cover body 81.

The lever unit 83, when the cover part 82 is arranged at the closed position illustrated in FIGS. 9A and 9B, is guided in a state of having been inserted into a quadrangular notch part 81*b*, provided as a recess at an edge of the cover body 81 on the side opposite to the window unit 81*a* in the movement direction X. The lever unit 83 is located on the movement path of the carriage 18, and projects upward to a height permitting engagement with the carriage 18. Pushing in on the lever unit 83, which is at the closed position illustrated in FIG. 9A, in the leftward direction in FIGS. 9A and 9B, the carriage 18 moves the slider 84 and thereby causes the cover part 82 to be arranged at the open position, illustrated in FIG. 9B. With the cover part 82 at the open position, the window unit 81*a* is open and the reference reflecting surface 75 (see FIGS. 4, 6, and 10) is exposed.

Figure 10A:
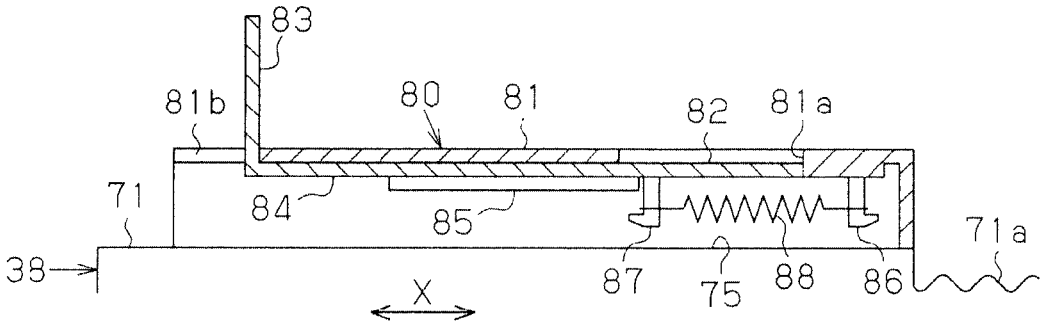
FIGS. 10A and 10B are schematic front sectional views illustrating an opening/closing operation of a cover unit.
Figure 10B:
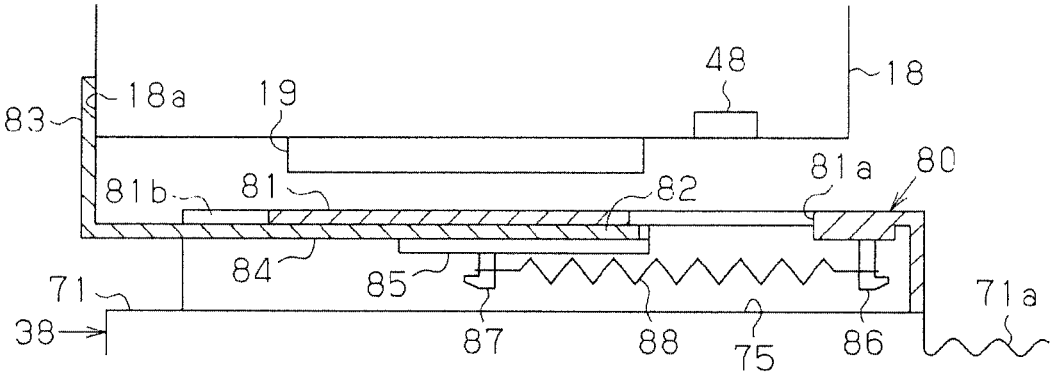
Figure 11:
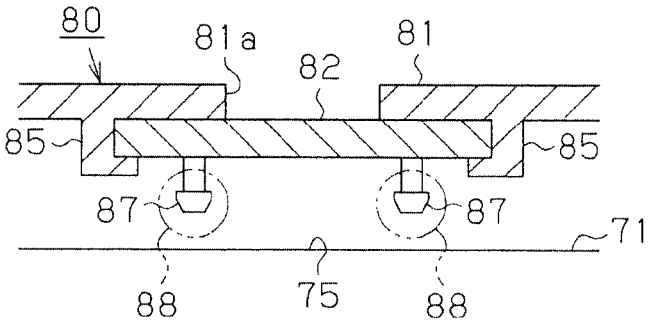
FIG. 11 is a schematic side sectional view illustrating a peripheral portion of a cover in a cover unit.

As illustrated in FIGS. 10 and 11, a pair of guide rail parts 85 are formed on a back side of an upper wall part of the cover body 81 so as to extend along the movement direction X. The slider 84, guided by the pair of guide rail parts 85, is able to slide in the movement direction X. As illustrated in FIGS. 10A and 10B, two edges of a coil spring 88, serving as one example of an urging unit, are latched onto a pair of latch parts 86, 87, which protrude downward from the back side of the upper wall part of the cover body 81 and from a lower surface of the slider 84, respectively; the slider 84 is urged in the direction for closing the cover part 82 by the coil spring 88. As illustrated in FIG. 11, the coil spring 88 avoids the region corresponding to the window unit 81*a*, and two of the coil springs are provided to the two sides thereof in the feeding direction Y. For this reason, when the carriage 18 is retracted toward the home position from the setting position illustrated in FIG. 10B, the urging force of the coil springs 88 causes the slider 84 to move in the rightward direction in FIG. 10B, thus closing off the cover part 82.

Figure 12A:
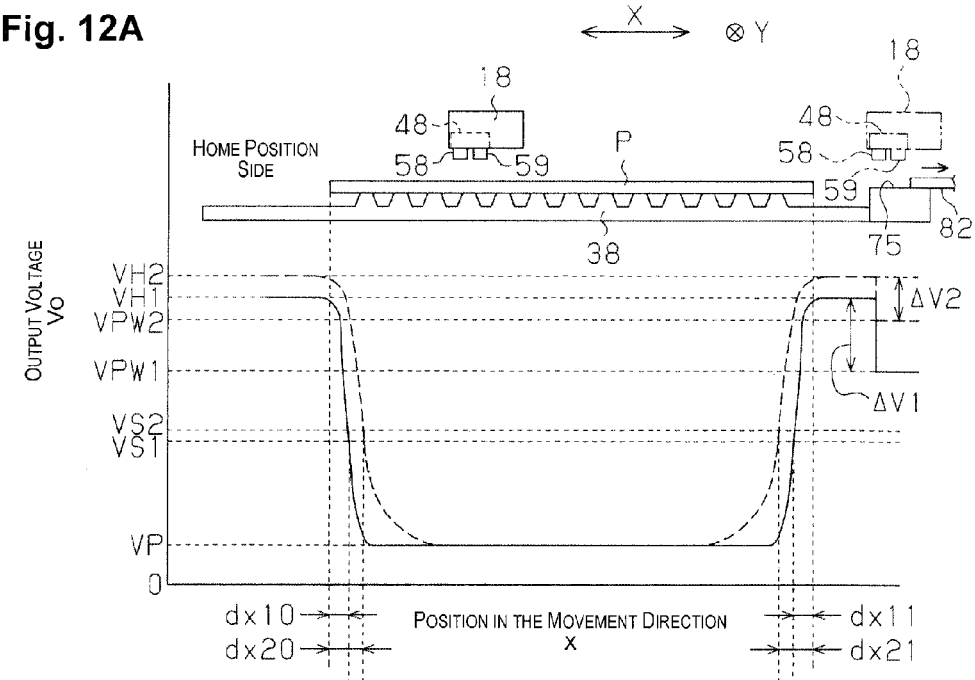
FIG. 12A is a graph illustrating the relationship between the output voltage and the position in a movement direction of a sheet width sensor.

The sensitivity switching performed when the degree of sullying of the sheet width sensor 48 is higher shall now be described, with reference to FIGS. 12A-12D. FIG. 12A illustrates the example of a case where the carriage 18 moves in the movement direction X and the edge of the sheet of paper P are detected by the sheet width sensor 48, in a state where the sheet of paper P has been conveyed as far as a position where the support base 38 (more specifically, the upstream support surface 71) is covered. The graph illustrated in FIG. 12A illustrates the relationship between a position x (hereinafter, also called a "sensor position x" of the sheet width sensor 48 in the movement direction X, and the output voltage Vo of the light-receiving unit 59. In this graph, the graph line illustrated by the solid line illustrates the relationship between the sensor position x and the output voltage Vo at an initial stage before the sheet width sensor 48 has been sullied, and the graph line illustrated by the dashed line illustrates the relationship between the sensor position x and the output voltage Vo at a point in time where the sheet width sensor 48 has been sullied from the initial state and has reached a degree of sullying of such an extent that the sensitivity thereof reaches the allowable sensitivity limit.

Figure 12B:
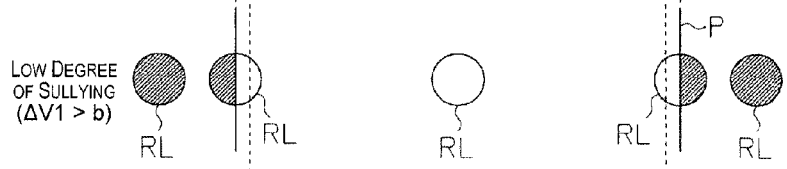
FIGS. 12B to 12D are schematic plan views illustrating the relationship between a sheet of paper and reflected light.
Figure 12C:
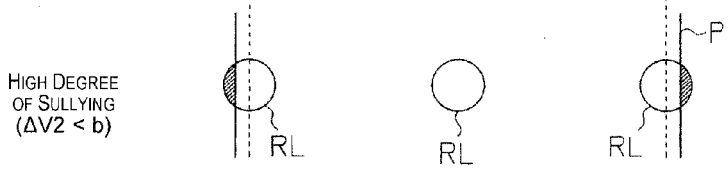
Figure 12D:
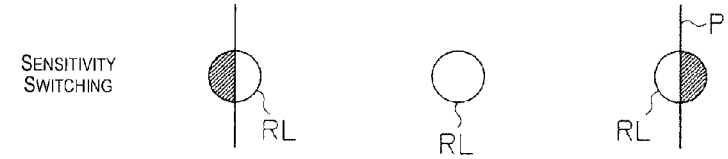

FIGS. 12B to 12D illustrate the manner in which a column of reflected light RL is reflected by the groove parts 71*a* or the sheet of paper P before being received by the light-receiving unit 59 when the edge position of the sheet of paper P is being detected. Of the reflected light RL, these drawings use a dark grey color to indicate a dark region where a lesser amount of light is reflected by the groove parts 71*a*, and use a white color to indicate a bright region where a greater amount of light is reflected by the surface of the sheet of paper P. Herein, FIG. 12B illustrates an initial state, prior to when the sheet width sensor 48 is sullied, at an initial first sensitivity, and FIG. 12C illustrates when the degree of sullying of the sheet width sensor 48 has reached the allowable limit of the first sensitivity. FIG. 12D illustrates a state of when there has been a switch from the first sensitivity to a second sensitivity. In FIGS. 12B to 12D, the edge of the sheet of paper P is indicative of the edge detection position, and is depicted as being offset slightly inward from the actual edge of the sheet of paper P illustrated in FIG. 12A.

When the outside of the sheet of paper P is what is intended to be detected, in FIG. 12B (when the reflected light RL is the dark grey color), a high output voltage VH1 is outputted from the light-receiving unit 59, which receives the reflected light RL where a lesser amount of light is reflected by the groove parts 71*a*. Then, when the region that is reflected by the sheet of paper P accounts for one half of the reflected light RL, then the output voltage Vo will become less than a threshold value VS1, which is ½ of the output voltage Vh1, and a first edge of the sheet of paper P (the left-side end in FIG. 12B) is detected. Furthermore, in a section where the sheet of paper P is what is intended to be detected, an output voltage VP (paper voltage) adequately smaller than the threshold value VS1 is outputted from the light-receiving unit 59, which receives the reflected light RL where a greater amount of light is reflected by the surface of the sheet of paper P. Then, when the region that is reflected by the sheet of paper P accounts for one half of the reflected light RL, then the output voltage Vo will become greater than the threshold value VS1, and a second edge of the sheet of paper P (the right-side end in FIG. 12B) is detected.

Thereafter, when the degree of sullying of the sheet width sensor 48 is higher, the amount of reflected light RL will become correspondingly smaller. For this reason, as illustrated in FIG. 12C, even though the region that is reflected by the sheet of paper P accounts for one half of the reflected light RL, the output voltage Vo will not become less than a threshold value VS2 but rather for the first time will account for nearly 80%, and thus the output voltage Vo will be less than the threshold value VS2, as is illustrated by the dashed line in FIG. 12A. For this reason, when the sullying of the sheet width sensor 48 progresses, the position where the edge of the sheet of paper P is detected shifts inward in the width direction of the sheet of paper P (i.e., in the movement direction X). The amount of this shift will be a detection error that is caused by the difference in the degree of sullying of the sheet width sensor 48.

An amount of positional deviation exists between the edge detection position where the edge of the sheet of paper P is detected and the actual position of the edge of the sheet of paper P. The amount of positional deviation varies depending on the degree of sullying of the sheet width sensor 48. In the present embodiment, the edge detection position of the sheet of paper P is corrected with the correction amount dx, which is equivalent to this amount of positional deviation. The non-volatile memory 54 stores correction table data (not shown) in which the relationship of correspondence between output voltages VPW and correction amounts dx are set for different types of paper.

In an initial state, where the degree of sullying is low, illustrated in FIG. 12B, the edge detection position of the sheet of paper P is corrected with a correction amount dx10 (or dx11), acquired by consulting the correction table data on the basis of a output voltage VPW1, and the exact position of the first edge (or second edge) of the sheet of paper P is acquired. In a state where the degree of sullying is higher, illustrated in FIG. 12C, the edge detection position of the sheet of paper P is corrected by a correction amount dx20 (or dx21) acquired by consulting the correction table data on the basis of an output voltage VPW2, and the exact position of the first edge (or second edge) of the sheet of paper P is acquired. In this example, the position x has positional coordinates set so that the direction going from the home position towards the anti-home position (the cover unit 80 side) is a positive direction. For this reason, the correction amounts dx10, dx20 for cases where the detection position of the first edge on the home position side are to be corrected take negative values, and the correction amounts dx11, dx21 for cases where the detection position of the second edge on the anti-home position side are to be corrected take positive values.

Meanwhile, in the sensitivity setting processing, the carriage 18 is moved from the home position to the setting position at a predetermined timing, such as when the power source of the printer 11 is turned on or when the cumulative number of printed sheets reaches a setting number of sheets, and the output voltage VPW outputted by the light-receiving unit 59 receiving the reflected light formed when the irradiated light from the light-emitting unit 58 is reflected by the reference reflecting surface 75 is acquired. Also, at a position where the sheet width sensor 48 faces the groove parts 71*a* while the carriage 18 is in the process of moving at this time, an output voltage VH outputted by the light-receiving unit 59 receiving the reflected light formed when the irradiated light from the light-emitting unit 58 is reflected by the groove parts 71*a* is acquired. Then, the sensitivity setting processing unit 62 funds a difference ΔV between the output voltage VH and the output voltage VPW (=VH−VPW), as a sensitivity determination value, and determines that the measurement sensitivity, having declined due to sullying, has reached the allowable limit in response to the sensitivity determination value ΔV becoming less than a setting value b and satisfying a sensitivity switching condition. The sensitivity setting processing unit 62 then, upon determining that the ΔV<b holds true and that the measurement sensitivity has reached the allowable limit, alters the setting value of the sensitivity setting circuit 60 and switches the sensitivity of the light-receiving unit 59 to a sensitivity that is one stage higher. In the present embodiment, the output voltage VPW is equivalent to one example of a first output value, and the output voltage VH is equivalent to one example of a third output value. Also, ΔV is equivalent to one example of a measurement sensitivity.

As illustrated in FIG. 12B, during the initial state where the degree of sullying is low and while the degree of sullying has not reached the allowable limit of sensitivity, the sensitivity of the light-receiving unit 59 is not switched, because as illustrated in FIG. 12A, a sensitivity determination value ΔV1, illustrated by the difference between the output voltage VH1 and the output voltage VPW1, is greater than the setting value b (ΔV1>b). However, when the degree of sullying reaches the allowable limit of sensitivity, as illustrated in FIG. 12C, then the sensitivity of the light-receiving unit 59 is switched to a sensitivity that is one stage higher, because as illustrated in FIG. 12A, the sensitivity determination value ΔV2, illustrated by the difference between the output voltage VH2 and the output voltage VPW2, has become lower than the setting value b (ΔV2<b). As a result, as illustrated in FIG. 12D, the edge of the sheet of paper P will be detected at a point in time where the region that is reflected by the sheet of paper P accounts for one half of the reflected light RL, similarly with respect to the initial state (FIG. 12B).

Figure 13:
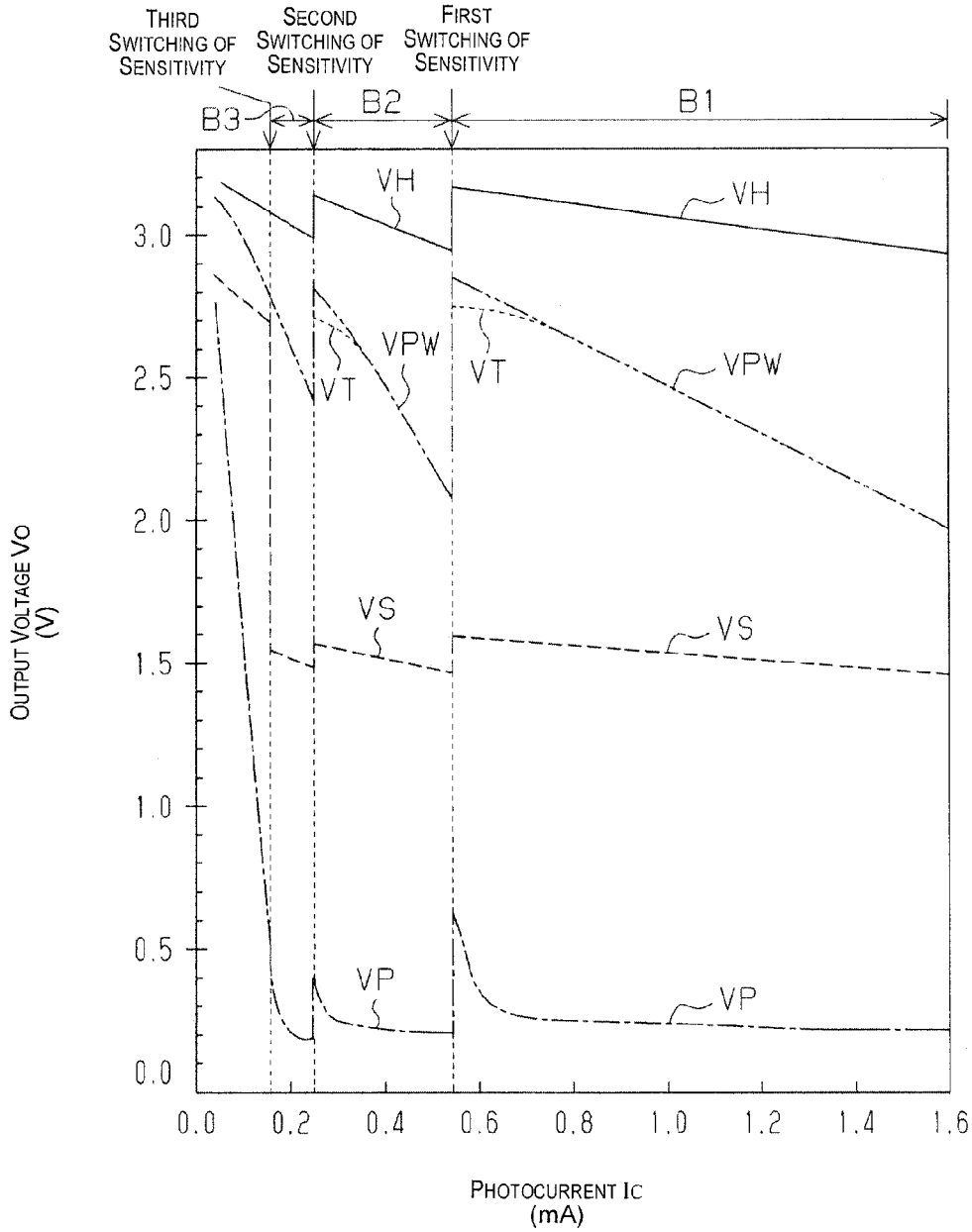
FIG. 13 is a graph illustrating the relationship between a photocurrent and the output voltage, and describing switching of the sensitivity.
Figure 14:
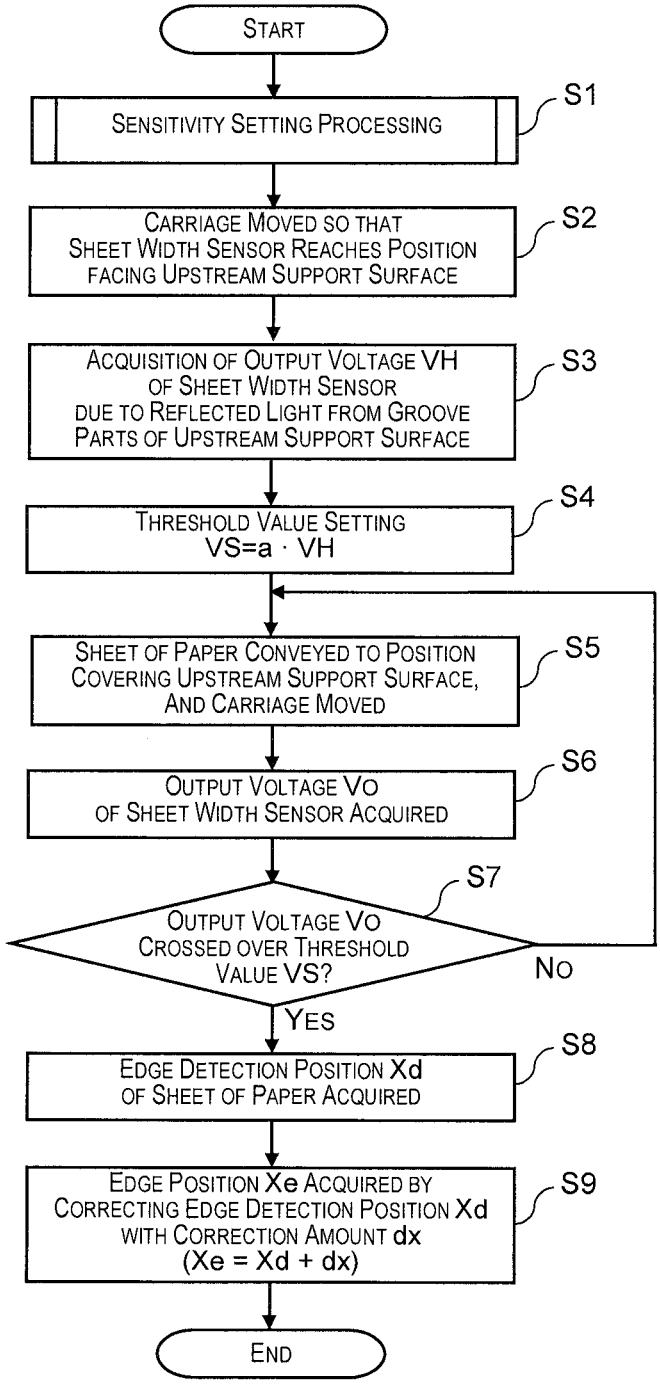
FIG. 14 is a flow chart illustrating a paper sheet edge position detection processing routine.
Figure 15:
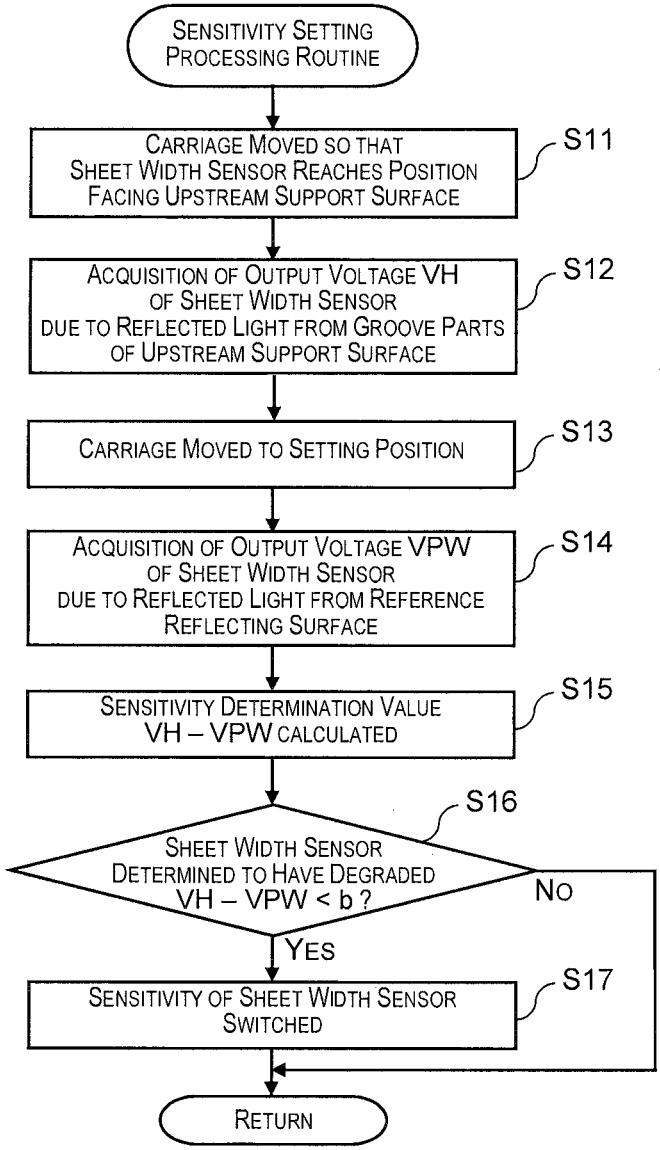
FIG. 15 is a flow chart illustrating a sensitivity setting processing routine.

The graph illustrated in FIG. 13 is for describing the sensitivity switching processing for applying the control signal to the base of the transistor T1 in FIG. 8 and switching the sensitivity of the light-receiving unit 59. The horizontal axis in this graph is a photocurrent Ic, and the vertical axis is the output voltage Vo. The output voltage VH illustrated with the solid line in FIG. 13 is an output voltage that is outputted by the light-receiving unit 59 receiving the reflected light formed when the irradiated light from the light-emitting unit 58 is reflected by the groove parts 71*a*. The output voltage VP illustrated with the one-dot chain line is an output voltage outputted by the light-receiving unit 59 receiving the reflected light formed when the irradiated light from the light-emitting unit 58 is reflected by the sheet of paper P. The threshold value VS illustrated with the dashed line is set to be a value found by multiplying a predetermined constant a (where 0<a<1) by the output voltage VH. In the present embodiment, the constant a is, for example, 0.5. The output voltage VPW, illustrated with the two-dot chain line, is an output voltage outputted by the light-receiving unit 59 receiving the light formed when the reference reflecting surface 75 illustrated in FIGS. 4, 6, 10, and the like is irradiated with light from the light-emitting unit 58 and the light is reflected by the reference reflecting surface 75.

As the ink mist, paper dust, and the like attaches to the sheet width sensor 48 and the degree of sullying becomes increasingly higher, the photocurrent Ic decreases. As will be understood from the graph illustrated in FIG. 13, as the photocurrent Ic decreases, the output voltage VH by which the groove parts 71*a* are detected and the output voltage VPW by which the reference reflecting surface 75 is detected gradually become greater at a predetermined slope (gradient). At this time, there is an angle of slope (a steep gradient) where the slope of the output voltage VPW is greater than the slope of the output voltage VH, and thus as the degree of sullying increases, the sensitivity determination value ΔV (=VH−VPW) gradually becomes smaller. The setting value b for determining the allowable limit of the sensitivity of the light-receiving unit 59 is set to a value equivalent to the difference ΔV at a point in time where the output voltage VP (paper voltage) by which the sheet of paper P is detected is first elevated from a substantially constant value and reaches a predetermined value sufficiently smaller than the threshold value VS.

In the graph in FIG. 13, the dashed line extending in the longitudinal direction illustrates the sensitivity switching position at which the sensitivity of the light-receiving unit 59 is switched. In a region where the output voltage VP, having sharply increased, takes a value equivalent to or greater than the threshold value VS, the output voltage VP will take a value equivalent to or greater than the threshold value VS at all times, and therefore the edge of the sheet of paper P can no longer be detected. For this reason, in a range of the photocurrent IC where the output voltage VP, having begun to increase sharply, becomes a value sufficiently smaller than the threshold value VS, the light-receiving unit 59 is used at the same sensitivity, and when the photocurrent Ic becomes smaller than this range, the sensitivity of the light-receiving unit 59 is switched toward being one stage higher, thereby making it possible to detect the edge of the sheet of paper P. When the sensitivity determination value ΔV (=VH−VPW) becomes smaller than the setting value b (ΔV<b), the sensitivity of the light-receiving unit 59 of the sheet width sensor 48 is switched toward being one stage higher. For this reason, the sheet width sensor 48 can be used in a range of sensitivity where the output voltage VP takes a value that is sufficiently smaller than the threshold value VS.

Herein, the sensitivity that is used in a range B1 of the photocurrent Ic until when the sensitivity is switched for the first time is a first sensitivity, which is initially set; the sensitivity that is used in a range B2 until when the sensitivity is switched for a second time, after the first time when the sensitivity was switched, is a second sensitivity; and the sensitivity that is used in a range B3 until when the sensitivity is switched for a third time, after the second time when the sensitivity was switched, is a third sensitivity. The minimal photocurrent Ic in the range B2 of the photocurrent is smaller than the minimal photocurrent Ic in the range B1 of the photocurrent. Further, the minimal photocurrent Ic in the range B3 of the photocurrent is smaller than the minimal photocurrent Ic in the range B2 of the photocurrent.

Switching the sensitivity in this manner makes it possible to broaden the range of the photocurrent Ic where the output voltage VP for detecting the sheet of paper P reaches a value sufficiently smaller than the threshold value VS (i.e., the extent of the degree of sullying), toward the side where the photocurrent Ic becomes smaller (i.e., toward the side where the degree of sullying becomes greater), even though the degree of sullying of the sheet width sensor 48 becomes higher and there is a decline in the photoelectric current Ic of the light-receiving unit 59. For this reason, it is possible to broaden the range where the output voltage VP outputted from the light-receiving unit 59 and the threshold value VS can be compared to detect the edge of the sheet of paper P. In the present embodiment, when the sensitivity determination value ΔV becomes smaller than the setting value b (ΔV<b) while the sensitivity of the light-receiving unit 59 is the final third sensitivity, then the control unit 50 alters the setting value of the emitted light amount setting circuit (not shown) and switches the emitted light amount of the light-emitting unit 58 toward being one stage greater. The reason for following such a procedure, where first the sensitivity of the light-receiving unit 59 is switched in a plurality of stages and, after the switching of the sensitivity has been entirely concluded, the amount of light emitted by the light-emitting unit 58 is then switched, is in order to avoid as much as possible an increase in the power consumed caused by increasing the amount of light emitted by the light-emitting unit 58.

The operation of the printer 11 shall now be described. The paper edge position detection processing for detecting the position of the edge of the sheet of paper P shall be described on the basis of FIGS. 14 and 15. The control unit 50 executes a program for a paper edge position detection processing routine illustrated by the flow chart in FIG. 14, and for a sensitivity setting processing routine illustrated in FIG. 15, which is equivalent to a sub-routine thereof. In an initial state where the printer 11 is powered up for the first time after purchase, the sensitivity of the light-receiving unit 59 is at the first sensitivity. The first sensitivity is a relatively low sensitivity, and thus erroneous detection arising due to the sensitivity of the light-receiving unit 59 being too high is curbed.

In step S1, the sensitivity setting processing is carried out. That is, the sensitivity setting processing unit 62 inside the control unit 50 sets the sensitivity of the sheet width sensor 48. In the present embodiment, the sensitivity setting processing unit 62 carries out the sensitivity setting processing at, for example, a point in time where the user operates the power source switch 23 and the power source of the printer 11 is turned on, and at a point in time where the cumulative number of sheets printed reaches a setting number of sheets (a setting value) during start-up of the printer 11. The sensitivity setting processing shall be described in greater detail below.

In the next step S2, the carriage 18 is moved so as to reach a position where the sheet width sensor 48 faces the upstream support surface 71. More specifically, the control unit 50 drives the carriage motor 35 and moves the carriage 18 so as to reach a position where the sheet width sensor 48 faces the groove parts 71*a* of the upstream support surface 71. The movement of the carriage 18 at this time may make concomitant use of the movement of the carriage 18 for during the sensitivity setting processing in step S1.

In step S3, the output voltage VH of the sheet width sensor 48 caused by the reflected light from the groove parts 71*a* of the upstream support surface 71 is acquired. In step S4, the threshold value VS is set. That is, the threshold value VS is set to VS=a·VH. In the present embodiment, a=0.5 is adopted as one example, but the constant a can also adopt a suitable value within the range 0<a<1.

In the next step S5, the sheet of paper P is conveyed to a position where the upstream support surface 71 is covered, and the carriage 18 is moved. The control unit 50 initiates the driving of the carriage motor 35 at a timing where, for example, a leading end of the sheet of paper P crosses over the movement path of the sheet width sensor 48 in plan view, and causes the carriage 18 to move from the home position toward the anti-home position. At this time, the carriage 18 moves so that the sheet width sensor 48 passes through both ends of the sheet of paper P in the width direction.

In step S6, the output voltage Vo outputted from the light-receiving unit 59 of the sheet width sensor 48 is acquired. That is, the output voltage Vo of the sheet width sensor 48 while the carriage 18 is moving is acquired in a successive fashion.

In the next step S7, a determination is made as to whether or not the output voltage Vo has crossed over the threshold value VS. In other words, the edge detection processing unit 61 determines whether or not the output voltage Vo, having been greater than the threshold value VS, became less than the threshold value VS, or whether or not the output voltage Vo, having been smaller than the threshold value VS, became greater than the threshold value VS. In a case where the output voltage Vo did not cross over the threshold value VS, the flow returns to step S5, and the movement of the carriage 18 is continued. Then, while the carriage 18 is being moved, the processing in steps S5 and S6 is carried out in every predetermined cycle duration (a predetermined duration in the range of, for example, 10 microseconds to 100 milliseconds), until an affirmative determination is reached in step S7. When the output voltage Vo is determined in step S7 to have crossed over the threshold value VS, the flow proceeds to step S8. The conveyance of the sheet of paper in step S5 is stopped once the sheet of paper P has reached at a predetermined position where the upstream support surface 71 is covered.

In step S8, the edge detection position Xd of the sheet of paper P is acquired. In the present embodiment, the position of the sheet width sensor 48, i.e., the edge detection position Xd of the sheet of paper P is calculated by using the position of the carriage 18 ascertained from the count of the counter when the output voltage VP crossed over the threshold value VS, and the known distance between the position of the carriage 18 and the attachment position of the sheet width sensor 48.

In step S9, the edge position Xe is acquired by correcting the edge detection position Xd with the correction amount dx (Xe=Xd+dx). The edge detection processing unit 61 acquires the output voltage VPW of the light-receiving unit 59 receiving the reflected light formed when the carriage 18 is moved to the setting position and the irradiated light from the light-emitting unit 58 is reflected by the reference reflecting surface 75, as, for example, a carriage movement processing for concomitant use with the sensitivity setting processing (S1), or as a carriage movement processing separate from the sensitivity setting processing, at a predetermined time such as when the printer 11 is powered on. Also, the edge detection processing unit 61 consults the correction table data and writes onto a predetermined storage region of the non-volatile memory 54 the correction amounts dx1, dx2 for the first edge and the second edge corresponding to the output voltage VPW. The edge detection processing unit 61 reads from the predetermined storage region of the non-volatile memory 54 the correction amount dx that corresponds to the edge of the sheet of paper P that is detected at that time, from among the first edge and the second edge, and acquires the edge position Xe of the sheet of paper P by correcting the edge detection position Xd with this correction amount dx. When the edge position Xe of the first edge is acquired in step S9, the processing in steps S5 to S9 is carried out in a similar fashion for the second edge as well, and in step S9 the edge position Xe of the second edge is acquired.

In this manner, a correction using the correction amount dx corresponding to the sensitivity of the sheet width sensor 48 as determined from the degree of sullying at that time is implemented, even though the degree of sullying of the sheet width sensor 48 may have increased, reducing the amount of light received by the light-receiving unit 59 and causing changes in the amount of widthwise positional deviation between the edge detection position Xd of the sheet of paper P and the actual edge position of the sheet of paper P. As a result, it is possible to detect the edge position Xe of the sheet of paper in a relatively more exact fashion.

The sensitivity setting processing routine for step S1 shall now be described in greater detail. The sensitivity setting processing is carried out in a state where the upstream support surface 71 is not covered by the sheet of paper P. Firstly, in step S11, the carriage is moved so as to reach a position where the sheet width sensor 48 faces the upstream support surface 71. That is, the control unit 50 drives the carriage motor 35, and moves the carriage 18, for example, from the home position toward the anti-home position. The control unit 50 actuates the sheet width sensor 48 while the carriage 18 is in the process of moving.

In step S13, the output voltage VH of the sheet width sensor 48 caused by the reflected light from the groove parts 71*a* of the upstream support surface 71 is acquired. For example, the output voltage VH when the sheet width sensor 48 is at a position facing the groove parts 71*a* while the carriage 18 is in motion is acquired. A plurality of output voltages VH may also be acquired, for example, at different positions of the carriage 18, with the mean value thereof serving as the output voltage VH. It shall be readily understood that the output voltage VH may also be acquired in a state where the carriage 18 has been stopped at a position where the sheet width sensor 48 faces the groove parts 71*a*.

In the next step S13, the carriage 18 is moved to the setting position. When, for example, the acquisition of the output voltage (S 12) is finished in the midst of the process of moving the carriage 18 from the home position toward the anti-home position in step S11, then the movement of the carriage 18 is continued without alteration and the carriage 18 is moved to the setting position.

In step S13, the output voltage VPW of the sheet width sensor 48 caused by the reflected light from the reference reflecting surface 75 is acquired. The carriage 18 engages the lever unit 83 of the cover unit 80 just before arriving at the setting position, and pushes in on the lever unit to open up the cover part 82, and therefore when the carriage 18 reaches and stops at the setting position, the cover part 82 is in an opened state and the sheet width sensor 48 is in a state of facing the reference reflecting surface 75 with the window unit 81*a* of the cover body 81 interposed therebetween. The sensitivity setting processing unit 62 acquires the output voltage VPW of the sheet width sensor 48 when the carriage 18 is stopped at the setting position.

In step S15, the sensitivity determination value VH−VPW is calculated. In other words, the sensitivity determination value ΔV (=VH−VPW) is calculated. In the next step S16, a determination is made as regards the degradation of the sheet width sensor 48 (a sullying determination). More specifically, the sensitivity setting processing unit 62 determines whether or not the sensitivity determination value ΔV (=VH−VPW), indicated by the difference between the output voltage VH and the output voltage VPW, is less than the setting value b (ΔV<b). The routine ends without switching of the sensitivity of the sheet width sensor 48 when ΔV<b does not hold true and the sensitivity of the sheet width sensor 48 has not declined to the extent where the sensitivity needs to be switched. In turn, the flow proceeds to step S17 when ΔV<b does hold true and the sensitivity of the sheet width sensor 48 is determined to have declined to the extent where the sensitivity needs to be switched.

In step S17, the sensitivity of the sheet width sensor 48 is switched. That is, the sensitivity setting processing unit 62 alters the setting value of the sensitivity setting circuit 60 and alters the control signal (PWM signal) outputted to the sensitivity setting circuit 60 to a duty ratio corresponding to the altered setting value, thereby switching the sensitivity of the light-receiving unit 59 of the sheet width sensor 48 to a sensitivity that is one stage higher than the current sensitivity. In this manner, as illustrated in FIG. 13, the sensitivity of the sheet width sensor 48 is switched to a sensitivity that is one stage higher every time the sensitivity determination (ΔV<b).

When, for example, the sensitivity of the sheet width sensor 48 is not properly switched, then the output voltage V0 will not cross over the threshold value VS and it is no longer possible to detect the edge of the sheet of paper P. The output voltage VT illustrated with the thin dashed line in the graph in FIG. 13 illustrates an output voltage where, by way of demonstration, the reference reflecting surface is not protected by the cover and a reference reflecting surface to which paper dust or the like has attached is detected. In such a case, the sensitivity determination value ΔV (=VH−VT) will not become smaller than the setting value b even when there is a decline in the photocurrent Ic as far as the position of the first instance of sensitivity switching, and thus the sensitivity of the sheet width sensor is not switched. By contrast, in the present embodiment, the reference reflecting surface 75 is protected from the ink mist, paper dust, and the like by being covered with the cover unit 80, and thus the sensitivity determination value ΔV (=VH−VPW) will become less than the setting value b at the point in time where the photocurrent Ic reaches the sensitivity switching position. As a result, it is possible to switch the sensitivity of the sheet width sensor 48 at the proper timing in the progression of the sullying.

As has been described above, in the present embodiment, the effects illustrated below can be obtained.

(1) Covering the reference reflecting surface 75 with the cover unit 80 protects same from floating matter such as the ink mist and the paper dust, and causes the reference reflecting surface 75 to be less susceptible to fouling. For this reason, sullying of the reference reflecting surface 75 can be effectively avoided, and the reference reflecting surface 75 can be kept in a clean state at all times. In other words, the reflectivity of the reference reflecting surface 75 will not be changed by attached matter. As such, the sensitivity determination value ΔV indicated by the difference between the output voltage VH and the output voltage VPW of the light-receiving unit 59 receiving the reflected light from the reference reflecting surface 75 will be one that more exactly reflects a sensitivity that has declined due to sullying of the sheet width sensor 48. Because of this, the sheet width sensor 48 can be switched to a proper sensitivity at a point in time where the sullying of the sheet width sensor 48 has progressed and the sensitivity has become greater than the allowable limit. It is accordingly possible to detect the edge position of the sheet of paper P in a relatively more exact fashion. It is possible to avoid as much as possible a situation where, for example, sullying of the reference reflecting surface is the cause of a failure for the sensitivity of the sheet width sensor 48 to be switched and where it is thus no longer possible to detect the edge of the sheet of paper P.

(2) The sensitivity of the sheet width sensor 48 is switched by using as a sensitivity switching condition the event where the sensitivity determination value ΔV (=VH−VPW), indicated by the difference between the output voltage VH of the light-receiving unit 59 receiving the reflected light reflected by the groove parts 71*a* and the output voltage VPW of the light-receiving unit 59 receiving the reflected light reflected by the reference reflecting surface 75 protected by the cover part 82, becomes less than the setting value b. The sensitivity of the sheet width sensor 48 can accordingly be switched at a proper timing corresponding to the degree of sullying thereof.

(3) There is no need for a power source such as an electric motor to be provided, because of the adoption of the mechanical opening/closing drive unit where the pushing in on the lever unit 83 by the carriage 18 causes the cover part 82 to open up, powered by the pushing force thereof, and where, when the lever part 83 is no longer being pushed in on, the urging force of the coil spring 88 causes the cover part 82 to close up. It is accordingly possible to avoid an increase in the number of components, and further possible to also avoid an increase in the processing load for when the control unit 50 controls the power source.

(4) Floating matter is less prone to be deposited on the upper surface of the cover unit 80, because the reference reflecting surface 75 and the cover unit 80 are arranged on the outside of the liquid ejecting region PA. In particular, even the ink mist that is generated during maintenance of the liquid ejecting head 19 is less prone to be deposited, because the reference reflecting surface 75 and the cover unit 80 are arranged at the edge of the anti-home position side, which is the opposite side to the maintenance device 45, on the movement path of the carriage 18. When, for example, floating matter is deposited on the upper surface of the cover unit 80, there is a concern that some of the deposited matter may fall into the cover unit 80 and foul the reference reflecting surface 75 when the cover part 82 is open, but this type of fouling of the reference reflecting surface 75 can be avoided. It is accordingly possible to implement the switching of the sensitivity of the light-receiving unit 59 at a timing by which the reference reflecting surface 75 is less susceptible to being fouled and which is more properly corresponding to the degree of sullying of the sheet width sensor 48, in comparison to a configuration where the reference reflecting surface is arranged at a position within the liquid ejecting region PA or the vicinity of the upstream side of the liquid ejecting region PA in the upstream support surface 71.

(5) The sensitivity of the sheet width sensor 48 can be switched at a proper timing corresponding to the degree of sullying, because the carriage is moved to the setting position and the sensitivity setting processing is carried out every time the printer 11 is powered on and every time the cumulative number of printed sheets reaches a setting number of sheets (a setting value). It is possible to avoid a situation where, for example, the sensitivity setting processing is not implemented for a long period of time and the sheet width sensor 48 continues being used at an improper sensitivity. Also, the sensitivity setting processing is implemented frequently, and it will less frequently be necessary to wait for the end of the sensitivity setting processing before it is possible to start printing.

Second Embodiment

The second embodiment shall now be described on the basis of FIGS. 16 and 17. A cover unit 90 of the present embodiment is motorized. The paper edge position detection processing is similar with respect to the first embodiment. As illustrated in FIG. 16, the reference reflecting surface 75 protected by the cover unit 90 is arranged at a position facing the sheet width sensor 48 when the carriage 18 is at a mid-printing position, i.e., when the liquid ejecting head 19 is at a position facing the liquid ejecting region PA. More specifically, the reference reflecting surface 75 and the cover unit 90 for covering same are provided to a position sandwiched between a pair of upstream ribs 73 on the upstream support surface 71. The reference reflecting surface 75 is formed by mirror-finishing the flat upper end surface of a quadrangular-based spindle-shaped base part 76 of lesser height than the upstream ribs 73. The cover unit 90 has a quadrangular box-shaped cover body 91 which is provided vertically erected from the groove parts 71*a* and the top of which is opened; a quadrangular plate-shaped cover 93 is attached, in a guided state so as to be able to slide in a predetermined direction, to a pair of guide rails 92 formed at an upper end part of the cover body 91. The upper end of the cover unit 90 is set to a height which is lower than the upper end surface of the upstream ribs 73 and by which the sheet of paper P being supported on the upstream ribs 73 will not abut against the cover unit 90.

The cover unit 90 is within the movement range where the carriage 18 is located during printing, and when, for example, the cover unit 80 in the first embodiment is adopted, the result is that the carriage 18 pushes on the lever unit during printing and opens up the cover part, and therefore, to prevent this, the opening/closing operation of the cover 93 is motorized. FIGS. 17A and 17B illustrate the configuration of one example of a motorized cover unit 90.

As illustrated in FIGS. 17A and 17B, the cover 93 is driven to open and close by a rack-and-pinion mechanism provided with: a rack 94 fixed to the back surface thereof (the lower surface in FIGS. 17A and 17B) in a state of extending along the opening/closing direction thereof (the sliding direction); and a pinion 95 for meshed engagement with the rack 94. The pinion 95 meshes with a gear 96 disposed inside a communication hole 38*a* formed at a position in the vicinity of the base part 76 in the support base 38, and the gear 96 in turns meshes with a drive gear 98 fixed to an output shaft of an electric motor arranged on the lower side of the support base 38. For this reason, when the electric motor 97 is driven forward in a state where the cover 93 is at a closed position illustrated in FIG. 17A, the power transmitted via the gears 96, 98 causes the pinion 95 to turn forward, and a force that moves in the rightward direction in FIG. 17A is transmitted to the rack 94 which meshes with the pinion 95; the cover 93 then slides in the rightward direction along the guide rails 92. As a result, the cover 93 moves from the closed position to the open position illustrated in FIG. 17B, and the reference reflecting surface 75 is exposed in a state where the light from the light-emitting unit 58, which is located direction above same, can be reflected. When the electric motor 97 is driven in reverse in a state where the cover 93 is at the open position illustrated in FIG. 17B, then the cover 93 slides in the leftward direction in FIG. 17B along the guide rails 92, and is arranged at the closed position illustrated in FIG. 17A.

For example, the CPU 51 drives the electric motor 97 forward to open the cover 93 upon ascertaining from the count of the counter that the carriage 18 has moved to and stopped at the setting position facing the reference reflecting surface 75, or that the carriage has reached a predetermined position immediately before a predetermined distance of the setting position. The CPU 51 then, upon acquiring the output voltage VPW of the light-receiving unit 59 receiving the reflected light reflected by the reference reflecting surface 75, drives the electric motor 97 in reverse to close the cover 93.

According to the second embodiment, the following effects can further be obtained.

(6) Because of the motorized cover unit 90, the reference reflecting surface 75 can be arranged at a position facing the sheet width sensor 48 when the carriage 18 is at a position moving during printing. For example, during printing, the cover 93 can be opened to acquire the output voltage VPW in the midst of the carriage 18 moving into order to print. In such a case, it is possible to eliminate operation of the carriage 18 that is aimed solely at acquiring the output voltage VPW. Additionally, no decline in print throughput is incurred, because the output voltage VPW is acquired without stopping the carriage 18. It is further possible to achieve a smaller size for the printer 11, by laying out the reference reflecting surface 75 and the cover unit 80 further inward in the movement direction X than the edge of the support base 38, because the degree of freedom in the arrangement layout of the reference reflecting surface 75 is higher.

The embodiments described above can also be altered to the following modes. The cover unit, which was arranged at a position equivalent to the edge of the movement path of the carriage 18, as in the first embodiment, may also be a motorized cover unit as per the second embodiment. In such a case, as per the second embodiment, it is possible to adopt a configuration for carrying out the opening operation of the cover part when it is detected that the carriage 18 has moved to the setting position. Also, for example, as illustrated in FIGS. 18A and 18B, provided to the carriage are a moving rod 101 for detecting that the carriage 18 has arrived at the setting position, and a switch 102 which is switched on and off by the movement of the rod 101. When the carriage 18 is not at the setting position, the rod 101 is positioned at a protruding position by the urging force of a spring (not shown), and the switch 102 is in an off state; just before the carriage 18 arrives at the setting position, the rod 101 abuts against and pushes in on an abutting surface 103*a* of a wall part 103, and the switch 102 is turned on. An on signal of the switch 102 is outputted from the carriage 18 to the CPU 51 by way of a signal line inside of a flexible cable (not shown). When the on signal of the switch 102 is inputted, the CPU 51 drives the electric motor 97 and causes the cover 93 to be moved from the closed position to the open position. Then, upon acquiring the output voltage VPW, the CPU 51 drives the electric motor 97 and causes the cover 93 to be moved from the open position to the closed position.

The detection of the edge position by the detection unit is not limited to a configuration that is based on a comparison of the output voltage Vo (the first output value) and the threshold value VS. For example, in FIG. 12A, in the slope region where the output voltage changes at a sharp slope between the output voltage VH by which the groove parts are detected and the output voltage VP by which the sheet of paper is detected, the position of a point of intersection between an approximate straight line linearly approximating a portion where a point group of the output voltage Vo is lined up side by side in a linear fashion and an approximate straight line linearly approximating the output voltage VH at a plurality of points may be found as the edge detection position. The edge detection position may thus be detected on the basis of the first output voltage, and the use of the threshold value is not essential.

Because the threshold value varies depending on the extent of degradation of the sheet width sensor 48, due to the setting of the threshold value VS=a·VH, the correction amount may be set to a constant value in a case where the amount of positional deviation between the edge detection position Xd and the actual edge position falls within an allowable error, irrespective of differences in the extent of degradation thereof. The method for setting the threshold value can also be altered as appropriate; for example, a threshold value according to the ratio of each of the output voltages by which the groove parts and the ribs of the support base were detected by the optical sensor may be set, as per Patent References 2 and 2.

The position of the reference reflecting surface 75 covered by the cover unit 80 may be, for example, further toward the home position, coming outside of the liquid ejecting region PA, in the movement direction X. The reference reflecting surface 75 is still covered by the cover even with this configuration, and thus there is substantially no concern that the reference surface will be contaminated.

A lever format similar to that of the first embodiment may also be adopted in a configuration where the reference reflecting surface 75 and the cover unit are arranged below the positions through which the carriage 18 passes during printing. For example, as illustrated in FIG. 16, the lever format can be adopted in a configuration where the reference reflecting surface 75 and the cover unit are provided between a pair of the upstream ribs 73. For example, the lever unit is provided to an edge of the movement path of the carriage so as not to engage therewith during printing. Once the carriage 18 pushes in on the lever unit, the lever unit is locked at this pushing position, and the cover unit is held at the open position. The configuration is such that when thereafter the carriage 18 presses the lever unit, the locking is released, and when the carriage 18 moves away from the lever unit, the cover part in the cover unit is closed by the urging force of the spring.

In a case where a motorized cover unit is adopted, the power source used may be a solenoid, an electric cylinder, or the like. Further, the automatically opening/closing cover unit is not limited to being motorized; for example, an air cylinder or a hydraulic cylinder may be adopted as the power source.

The arrangement positions of the reference reflecting surface and the cover unit are not limited to being positions other than the liquid ejecting region PA. For example, the reference reflecting surface and the cover unit may also be arranged so as to be partially or entirely located inside the liquid ejecting region PA in the support base 38.

The reference reflecting surface is not limited to a configuration fixed to the support base such as by being integrally formed on the support base; rather, the configuration may be such that the cover provided to the support base, upon opening, is elevated in the direction drawing near to the carriage from behind the lower side thereof. Furthermore, the reference reflecting surface is not limited to being arranged at a position where the reference reflecting surface is able to face in the direction by which the sheet width sensor faces the sheet of paper or other medium. For example, the sheet width sensor may be provided to the carriage 18 so that the angle can be changed, and a reference reflecting surface which is a vertical plane may then be provided to a position other than the support base, e.g., on a side wall surface of a body frame of the printer, the reference reflecting surface then being covered with the cover unit. In such a case, the orientation of the sheet width sensor may be altered in a state where the cover part has been moved to the open position, to acquire the output voltage VPW of the light-receiving unit having received the reflected light from the reference reflecting surface.

The timing for implementing the sensitivity setting processing is not limited to the timing when the power is turned on and the like, but rather may also be during printing. For example, the sensitivity setting processing may be carried out during paper feeding/discharging, when the page being printed is switched, or during a flushing in which the carriage is moved to the edge of the movement path to eject ink into a liquid drain unit for the purpose of maintaining the nozzles of the liquid ejecting head. The sensitivity setting processing may also be carried out during end processing when the power is turned off. The sensitivity setting processing may additionally be carried out every time the cumulative print duration reaches a setting duration.

The optical sensor for detecting the widthwise edge position of the medium is not limited to being a sheet width sensor the purpose of which is to acquire the sheet width or is to determine an ejection start position (print start position) in the movement direction X (main scanning direction) of the liquid ejecting head 19. For example, the purpose may be merely to acquire the edge position of the medium in the width direction. The purpose may also be to detect the skew (slant) of the medium. The purpose of the optical sensor may additionally be to detect the edge of the medium in the conveyance direction. In such a case, the carriage is arranged in a conveyance area prior to conveyance of the medium, and thereafter the medium is conveyed so as to pass below the carriage, whereby the edge of the medium in the conveyance direction is detected by the optical sensor.

The detection circuitry of the sheet width sensor 48 was a circuit configuration in which the output voltage Vo is smaller when a greater amount of light is received by the light-receiving unit 59 and in which the output voltage Vo is greater when a lesser amount of light is received; however, in a reversal therefrom, a circuit configuration may be adopted in which the output voltage is greater when a greater amount of light is received by the light-receiving unit 59 and in which the output voltage Vo is smaller when a lesser amount of light is received.

Each of the functional units inside the control unit 50 (computer) in FIGS. 3A and 3B is achieved primarily with software by a CPU that executes programs, but, for example, each of the functional units may also be achieved with hardware by an integrated circuit, or may be achieved by cooperation between software and hardware.

The printer, which is one example of a liquid ejecting apparatus, may also be a lateral-type printer. In essence, the printer should be provided with a carriage. Also, the liquid ejecting apparatus may be a multifunction peripheral provided with a plurality of functions, including a scanner function, copy function, and the like, in addition to the printer function.

The medium is not limited to being a sheet of paper, but rather may also be a resin film, a metal foil, a metal film, a composite film of resin and metal (a laminate film), a textile, a non-woven fabric, a ceramic sheet, or the like. Further, the shape of the medium is not limited to being a sheet, but may rather be a three-dimensional shape.

In the embodiments described above, the invention was embodied in an inkjet printer, which is one type of liquid ejecting apparatus, but there is no limitation to printers in cases where the invention is applied to a liquid ejecting apparatus. For example, the invention can also be embodied in a liquid ejecting apparatus for ejecting or discharging a different liquid other than ink (including a fluid body such as a liquid body or gel that is formed by dispersing or mixing particles of a functional material into a liquid). For example, the invention may be a liquid ejecting apparatus for ejecting a liquid body that includes, in a dispersed or dissolved form, a material such as a colorant (a pixel material) or an electrode material used, inter alia, to produce liquid crystal displays, electroluminescence (EL) displays, or surface emitting displays. The invention may further be a liquid ejecting apparatus for ejecting bio-organic matter used in the production of biochips, or a liquid ejecting apparatus for ejecting a liquid serving as a test sample, used as a precision pipette. Furthermore, the invention may be: a liquid ejecting apparatus for ejecting onto a substrate a translucent resin solution, such as a thermosetting resin, for forming, inter alia, a hemispherical micro lens (optical lens) used in an optical communication element or the like; a liquid ejecting apparatus for ejecting an etching solution, such as an acid or an alkali, to etch a substrate or the like; or a fluid ejecting apparatus for ejecting a fluid such as a gel (for example, a physical gel) or the like. The invention can be applied to any of these types of fluid ejecting apparatuses. In this manner, the medium (recording medium) may also be a substrate on which an element, wiring, or the like is to be formed by etching. The "liquid" that is ejected by the liquid ejecting apparatus encompasses liquids (including inorganic solvents, organic solvents, liquid resins, liquid metals (metal melts), and the like), liquid bodies, fluid bodies, and the like.

The "measurement sensitivity" in the present specification need not necessarily be a physical quantity that is indicative of the sensitivity itself, but rather may also be a numerical value (parameter), reflective of a sensitivity of the optical sensor, whereby the sensitivity can be indirectly determined to have reached the allowable limit. For example, switching to the difference between the output voltages VH and VPW, the measurement sensitivity may be a ratio (=VH/VPW). Further, as is described in Patent References 2 and 3, the measurement sensitivity may be the ratio of each of the output voltages at which the ribs and the groove parts of the support base are detected by the optical sensor. In such a case, one of the ribs may serve as a base part that has been lowered in comparison to the other ribs, giving a configuration as illustrated in FIG. 16.

What is claimed is:

1. A liquid ejecting apparatus, characterized in being provided with:

a carriage that has a liquid ejecting head for ejecting a liquid toward a medium, and moves reciprocatingly in a movement direction that intersects with a conveyance direction of the medium;

an optical sensor which is provided to the carriage and has a light-emitting unit capable of irradiating light toward the medium and a light-receiving unit for receiving reflected light of the light and outputting an output value corresponding to an amount of light received;

a reflecting part that is used to measure a sensitivity of the optical sensor;

an openable and closable cover part for covering the reflecting part; and an open/close drive unit for opening/closing the cover part; wherein:

the cover part can be opened by the open/close drive unit, the carriage being arranged at a position where the optical sensor is made to face the reflecting part.

2. The liquid ejecting apparatus as in claim 1, wherein the open/close drive unit is provided with an engaged part with which the carriage can engage while in the process of moving, as well as with an urging unit for urging the cover part in a closing direction, and is configured so as to resist an urging force of the urging unit and move the cover part in an opening direction, powered by a force from when the carriage presses on the engaged part.

3. The liquid ejecting apparatus as in claim 1, wherein the open/close drive unit is provided with a power source for outputting power for opening/closing the cover part, and a control unit for controlling the power source and causing the cover part to be opened/closed.

4. The liquid ejecting apparatus as in claim 1, further comprising a detection unit for detecting an edge position of the medium, the output value being a first output value and the detecting unit using a second output value outputted by the light-receiving unit having received reflected light of the light irradiated by the light-emitting unit while the carriage is in the process of being moved in the movement direction, in a state where the medium is arranged at a position in the conveyance direction permitting detection by the optical sensor.

5. The liquid ejecting apparatus as in claim 1, wherein the setting of the sensitivity by the sensitivity setting unit is carried out at a timing of when the liquid ejecting apparatus is powered on and/or of when the number of media having undergone liquid ejection treatment by the liquid ejecting head reaches a setting value.

6. The liquid ejecting apparatus as in claim 1, wherein the reflecting part is arranged on the outside of a liquid ejecting region where the liquid is ejected from the liquid ejecting head.

7. The liquid ejecting apparatus as in claim 1, wherein the output value being a first output value, the sensitivity setting unit acquires a third output value outputted by the light-receiving unit having received reflected light formed when the light irradiated from the light-emitting unit is reflected by a support unit for supporting the medium, and carries out the sensitivity setting by using the first output value and the third output value.

8. The liquid ejecting apparatus as in claim 1, further comprising a sensitivity setting unit for acquiring a measurement sensitivity of the optical sensor by using the output value of the light-receiving unit having received the reflected light formed when the light irradiated from the light-emitting unit is reflected by the reflecting part, in a state where the cover part is opened by the open/close drive unit, and for switching the sensitivity of the light-receiving unit upon determining that the measurement sensitivity is greater than an allowable limit.

9. A sensor sensitivity setting method in a liquid ejecting apparatus, the method being characterized in comprising:

opening a cover part for covering in an openable and closable state a reflecting part used to measure a sensitivity of an optical sensor provided to a carriage having a liquid ejecting head;

measuring the sensitivity in a state where the carriage has been arranged at a position where a light-emitting unit and light-receiving unit of the optical sensor face the reflecting part, by using an output value of the light-receiving unit having received reflected light formed when light irradiated from the light-emitting unit is reflected by the reflecting part; and determining whether or not the measurement sensitivity acquired in the sensitivity measurement step is greater than an allowable limit, and for switching the sensitivity of the light-receiving unit upon determining that the measurement sensitivity is greater than the allowable limit.

* * * * *